US007523884B2

(12) United States Patent
Gelli et al.

(10) Patent No.: US 7,523,884 B2
(45) Date of Patent: Apr. 28, 2009

(54) REWINDING MACHINE WITH GLUING DEVICE TO GLUE THE FINAL EDGE OF THE LOG FORMED AND RELATIVE WINDING METHOD

(75) Inventors: Mauro Gelli, Lucca (IT); Romano Maddaleni, Pisa (IT)

(73) Assignee: Fabio Perini S.p.A., Lucca (IT)

( * ) Notice: Subject to any disclaimer, the term of this patent is extended or adjusted under 35 U.S.C. 154(b) by 144 days.

(21) Appl. No.: 10/535,424

(22) PCT Filed: Nov. 18, 2003

(86) PCT No.: PCT/IT03/00748

§ 371 (c)(1),
(2), (4) Date: Jun. 2, 2005

(87) PCT Pub. No.: WO2004/046006

PCT Pub. Date: Jun. 3, 2004

(65) Prior Publication Data

US 2006/0076450 A1 Apr. 13, 2006

(30) Foreign Application Priority Data

Nov. 20, 2002 (IT) ..... FI2002A0227

(51) Int. Cl.
*B65H 35/10* (2006.01)
*B65H 19/29* (2006.01)

(52) U.S. Cl. ..... 242/521; 242/532.3

(58) Field of Classification Search ..... 242/521, 242/527, 532.3, 527.4, 527.3, 527.2, 527.1
See application file for complete search history.

(56) References Cited

U.S. PATENT DOCUMENTS

| | | | | |
|---|---|---|---|---|
| 3,030,042 | A * | 4/1962 | De Gelleke | 242/527.3 |
| 3,073,008 | A * | 1/1963 | McGraw, Jr. | 29/25.42 |
| 3,393,105 | A | 7/1968 | Tellier, Jr. | |
| 3,532,573 | A | 10/1970 | Herman | |
| 3,553,055 | A | 1/1971 | Janik | |
| 3,791,602 | A * | 2/1974 | Isakson | 242/521 |
| 4,422,588 | A * | 12/1983 | Nowisch | 242/524.1 |
| 4,487,377 | A | 12/1984 | Perini | |
| 5,242,525 | A | 9/1993 | Biagiotti | |
| 5,603,467 | A | 2/1997 | Perini et al. | |
| 5,769,352 | A * | 6/1998 | Biagiotti | 242/521 |
| 5,979,818 | A | 11/1999 | Perini et al. | |

(Continued)

FOREIGN PATENT DOCUMENTS

EP 0 481 929 B1 4/1994

(Continued)

*Primary Examiner*—Peter M Cuomo
*Assistant Examiner*—William E Dondero
(74) *Attorney, Agent, or Firm*—Breiner & Breiner, LLC

(57) ABSTRACT

The rewinding machine comprises: winding elements (1, 3, 5) to wind the web material (N) and form the logs (L1, L2); at least a first glue dispenser (31B) to apply a first glue (C2) to a portion of said web material, in proximity to a severing line, along which the web material is severed upon termination of winding a log. The first glue dispenser comprises a mechanical element (31B) that touches the web material (N) upon termination of winding each log (L1, L2), to transfer the first glue to the web material (N).

28 Claims, 11 Drawing Sheets

U.S. PATENT DOCUMENTS 6,056,229 A * 5/2000 Blume et al. ..... 242/521

FOREIGN PATENT DOCUMENTS

| | | | |
|---|---|---|---|
| EP | 0 580 561 | B1 | 10/1996 |
| EP | 0 699 168 | B2 | 5/2003 |
| GB | 2 150 536 | A | 7/1985 |
| JP | 05-170362 | | 7/1993 |
| WO | WO 94/21545 | A1 | 9/1994 |
| WO | WO 97/32804 | A1 | 9/1997 |
| WO | WO 99/42393 | A1 | 8/1999 |
| WO | WO 00/68129 | A1 | 11/2000 |
| WO | WO 01/64563 | A2 | 9/2001 |
| WO | WO 01/64563 | A3 | 9/2001 |

* cited by examiner

REWINDING MACHINE WITH GLUING DEVICE TO GLUE THE FINAL EDGE OF THE LOG FORMED AND RELATIVE WINDING METHOD

TECHNICAL FIELD

The present invention relates to a method for producing logs of web material, for example rolls of toilet tissue, kitchen towels or the like.

The invention also relates to a rewinding or winding machine for forming logs destined to produce small rolls of wound web material.

The invention relates in particular, although not exclusively, to rewinding machines of the peripheral type, i.e. in which the log is formed in a winding cradle in contact with moving elements that transmit rotatory movement to the log through surface contact.

STATE OF THE ART

Currently, to produce rolls of toilet tissue, rolls of kitchen towels or similar products a web material is unwound from one or more parent reels of large diameter, coming directly from the paper mill, and predetermined quantities of web material are rewound on tubular winding cores to obtain logs of a length equivalent to the length of the parent reel but with a minor diameter, equivalent to the diameter of the final product. These logs are subsequently cut crosswise to their axis to produce logs or small rolls of web material destined to be packaged and distributed. Before cutting the rolls or logs into small rolls with minor axial dimensions, the initial free edge of the web material must be glued to adhere to the external surface of the log and thereby allow subsequent handling, without the risk of accidentally unwinding the web material.

The rewinding machines currently used wind the rolls or logs, which are then conveyed to a gluing unit that glues the final free edge of the web material. For this purpose, the individual logs are partially unwound and positioned to apply the glue to the unwound free edge or to a portion of the cylindrical surface of the log that is subsequently covered with the final free edge of the material by rewinding it.

Examples of gluing units to seal the final edge of a web material forming a log are described in U.S. Pat. No. 5,242,525, EP-A-0481929, U.S. Pat. No. 3,393,105, U.S. Pat. No. 3,553,055, EP-A-0699168.

To produce logs of web material rewinding machines of the peripheral type are preferably used, in which the log being formed is made to rotate through contact with a plurality of motor-driven winding rollers, a plurality of belts or with combined systems of belts and rollers. Examples of rewinding machines of this type are described in WO-A-9421545, U.S. Pat. No. 4,487,377, GB-B-2150536 and others.

With these traditional machines at least a rewinding machine and a gluing unit are required to obtain the completed and glued log, ready to be subsequently cut into small rolls. U.S. Pat. No. 4,487,377 describes a method that makes the use of a gluing unit downstream of the rewinding machine unnecessary. In this method, the web material is cut upon termination of winding a log and the final edge of the web material of the completed log is glued after cutting by transferring to it a glue previously distributed in annular bands on the tubular winding core fed into the winding area. The glue applied to the tubular core also serves to start winding the new log.

This system makes it possible to eliminate the gluing unit, although it requires a particular configuration of the rewinding machine, with a cutting blade disposed so as to cooperate cyclically with the winding roller. With a layout of this type it is not possible to attain the performances currently required of these machines in terms of production speed and production flexibility. Moreover, the quality of gluing is poor, as the glue is distributed according to arcs of circumference, rather than along a line parallel to the axis of the log, which are also spaced at a considerable distance from one another in an axial direction.

WO-A-9732804 describes a rewinding machine with a gluing unit incorporated. Nonetheless, owing to its design and to the layout of the gluing unit, this rewinding machine is only capable of reaching relatively low winding speeds. Indeed, gluing takes place by substantially decreasing the feed speed of the web material during-the exchange phase, i.e. when a finished log is unloaded from the winding area and winding of a new log commences.

WO-0164563 describes a rewinder wherein, upon termination of winding a log, a first glue is applied to the web material to seal the free edge of the formed log. A second glue is applied to the new winding core before it is fed to the machine. The first glue is applied with a system of nozzles, which have some drawbacks, in particular due to the fact that, especially at high production speeds, they are unable to apply the glue in a precise and definite way. The glue applied to glue the final edge of each log is not distributed optimally, especially when the production speed (that is the feed speed of the web material) is high. This poses a considerable problem, in particular when producing rolls of toilet tissue or the like with a small diameter, especially for domestic use where the accuracy of gluing the free edge of the log is essential.

OBJECTS AND SUMMARY OF THE INVENTION

The object of the present invention is to provide a method and a rewinding machine for producing logs of wound web material, which make it possible to accurately glue the final edge of the logs or logs, without requiring a gluing unit downstream of the rewinding machine or incorporated in it.

According to a particular aspect a further object of the present invention is to provide a method and a machine that make it possible to attain high performances in terms of production flexibility.

In substance, according to the invention, a rewinding machine is provided, preferably although not exclusively of the peripheral type, comprising in combination: winding elements to wind the web material in logs; means to sever the web material upon termination of winding each log; at least a first glue dispenser to apply a first glue to a portion of said web material, in proximity to a severing line, along which the web material is severed upon termination of winding a log to form a final free edge and an initial free edge, said first glue gluing the final free edge of the log. Characteristically, according to the invention the first glue dispenser comprises a mechanical element that touches the web material upon termination of winding each log, to transfer said first glue to the web material.

When, according to the preferred embodiment of the invention, the rewinding machine is of the peripheral type, it comprises a winding cradle and at least a first winding element around which said web material is fed. The glue dispenser can cooperate with said first winding element, the web material passing between the glue dispenser and the winding element.

The use of a mechanical element to apply glue through contact with the web material, rather than nozzles that spray glue on the web material, makes it possible to obtain a product of higher quality, wherein the free edge of the log is easily detached to allow use of the roll by the user, without damaging the layers of web material below, with minimum waste of material and accurate and precise metering of the glue.

The glue to make the final free edge of the log formed adhere can be a liquid or semi-liquid glue. Nonetheless, it would be possible also to use a non-liquid glue, for example in the form of a double-sided adhesive tape. In this case, the glue dispenser is provided with an element that if necessary prepares a length or several lengths of adhesive tape and subsequently applies it or them to the web material. The use of a non-liquid glue has the advantage of not weakening the web material and thereby does not create a preferential tear line or area other than the perforation line chosen to sever the web material. When, on the contrary, the glue is liquid or semi-liquid, in certain cases the glue can be applied subsequent to tearing or severing the web material, thereby preventing the material from tearing along the line of application of the glue instead of along the perforation line.

Winding can take place around a tubular core, on which a second glue can be applied if necessary by means of a second dispenser. The first and the second glue may be of a different nature, to satisfy the different requirements to glue the final free edge of a complete log and to fasten the initial free edge of a new log to the winding core. However, the invention may also be implemented on a rewinding machine that produces logs without a central winding core, such as a rewinding machine of the type described in EP-A-0580561.

Alternatively, the invention may be incorporated in a rewinding machine wherein the log is formed around a spindle or tubular winding core that is subsequently removed from the log, to obtain a finished product without a central core, as described for example in WO-A-0068129 or in WO-A-9942393. In this case a glue is not normally applied to the winding core or spindle but other temporary fastening systems of the initial free edge are used. Differently, water can be used instead of an actual glue and when it dries or is absorbed by the first turns of the wound material this allows the winding spindle or core to be subsequently removed with ease from the log formed.

According to a particularly advantageous embodiment of the invention, the first glue dispenser applies said first glue to a portion of the web material fed around the first winding element, which functions as a counter-pressure element.

The mechanical element of the first dispenser may be a rotating element, which is operated in synchronism with the exchange cycles, that is with the phases in which the web material is severed, a finished log is unloaded and a winding of a new log commences. This allows glue to be applied reliably and accurately, without damaging the web material.

According to an advantageous embodiment of the invention, the mechanical element that applies the glue to the web material has a pad suitable to pick up the glue and to touch the web material, in order to transfer at least part of the glue picked up to it. The glue may be picked up from a tank, from a dispensing roller or from another suitable element.

When the rewinding machine is designed to perform winding around a winding core, it typically comprises a feeder to feed the tubular winding cores on which the logs are wound to the winding cradle. Winding can commence by fastening the initial free edge of the new log to the tubular winding core by means of a glue. As already mentioned, this glue may be equal to or different from, as regards chemical and/or physical properties, the glue applied to seal the final free edge of the previously formed log. However, winding of the initial free edge of the new log around the winding core may be commenced in another way, instead of using a glue. For example, the winding core or spindle may have a suction system, as described in WO-A-0068129, or may be electrostatically charged, or yet again the first turn may be wound around the winding core with the aid of external air jets, or even a combination of the aforesaid means.

When the rewinding machine uses a feeder to feed the cores to the winding area, the mechanical element of the first glue dispenser may be associated with said feeder, for example it may be integral with it. In this way, correct synchronism between application of the glue to glue the final free edge of the completed log and feed of a new core are simple to obtain. Moreover, a particularly simple rewinding machine with a limited number of mechanical elements is obtained.

For example, the feeder of the cores may have an oscillating or rotating seat, with which the mechanical element of the glue dispenser is integral.

According to a different embodiment, the means to sever the web material upon termination of winding each log comprise a rotating severing element, cooperating with the first winding element (typically a winding roller). In this case, advantageously, the mechanical element of the first glue dispenser can be associated with said severing element. For example, the mechanical element of the glue dispenser may be integral with the severing element. Alternatively, it may be part of the actual severing element. Also in this case the structure of the rewinding machine is considerably simplified and its mechanical elements are reduced.

In an embodiment of this type when the severing element is in contact with the web material it may have a peripheral speed differing from the peripheral speed of said first winding element. According to the layout of the machine, this speed may be higher or lower than the speed of the first winding element. In the first case the web material is severed between the position in which the severing element touches the web material and the new winding core fed to the machine. In the second case severing typically takes place between the severing element and the log in the completion phase. According to the solution adopted, the position of the mechanical element that applies the glue to seal the final free edge of the finished log changes in respect of the severing element.

In a per se known way, the rewinding machine can have a rolling surface defining with the first winding element a channel for feeding the winding cores. The winding cores are fed into said channel and made to roll inside it before the web material is severed.

To obtain clean gluing of the final free edge of each log, consequently making the roll easy to open when it is used by the final consumer, the first glue dispenser applies glue along a longitudinal band, continuous or broken, on the web material, positioned at a suitable and modifiable distance from the edge of the material.

The invention also relates to a method to produce logs of wound web material, comprising the phases of: winding a quantity of web material to form a first log in a winding area; upon termination of winding said first log, severing the web material to create a final edge of the first log and an initial edge to form a second log; applying a first glue to a portion of the web material destined to remain wound on the first log, in proximity to the final free edge, which is glued to the first log unloading said log from the winding area. Characteristically, according to the invention, the first glue is applied to the web material by a mechanical element that comes into contact with said web material. Application may take place before or after severing of the web material.

Further advantageous characteristics and embodiments of the rewinding machine and of the method according to the invention are indicated in the appended claims.

BRIEF DESCRIPTION OF THE DRAWINGS

The invention shall now be better understood by following the description and accompanying drawing, which shows a non-limiting practical example of the invention. In the drawing.

DETAILED DESCRIPTION OF THE PREFERRED EMBODIMENTS OF THE INVENTION

Figure 1:
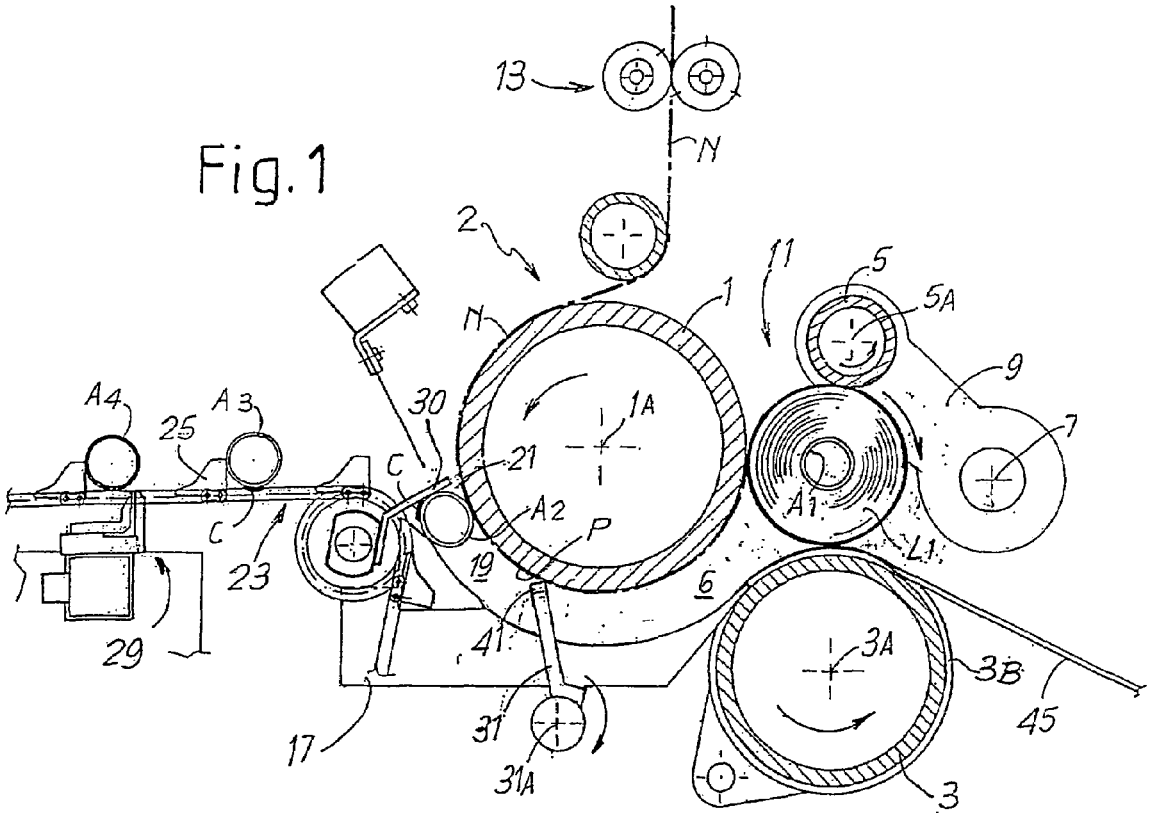
FIGS. 1 to 4 show a first embodiment of the rewinding machine according to the invention in four different moments of the winding cycle, in a schematic side view.

FIGS. 1 to 4 show, limited to its principal elements, a first embodiment of a rewinding machine according to the invention in four distinct positions during the winding cycle.

The rewinding machine, indicated as a whole with 2, comprises a first winding roller 1, rotating around an axis 1A, a second winding roller 3, rotating around a second axis 3A parallel to the axis 1A, and a third winding roller 5, rotating around an axis 5A parallel to the axes 1A and 3A; The winding roller 5 is supported by oscillating arms 9 hinged around an oscillation axis 7.

The three winding rollers 1, 3 and 5 define a winding cradle 11 inside which, in the position shown in FIG. 1, a first log L1 of web material is found in the final winding phase.

A nip 6 is defined between the winding rollers 1 and 3 through which the web material N passes, which is wound around a tubular core A1 to form the log L1. The web material N is fed around the first winding roller 1 and, before reaching it, through a perforator unit 13 that perforates the web material N along the perforation lines equidistant and substantially orthogonal to the direction of feed of the web material. In this way the web material N wound on the log L1 is divided into sheets that can be separated individually by being torn by the final user.

A rolling surface 15, essentially concave cylindrical and substantially coaxial to the winding roller 1, extends around a portion of said winding roller 1. The rolling surface 15 is formed by a series of strips parallel to and spaced apart from one another, one of which is shown in the drawing and indicated with 17, the others being superimposed on it. The strips 17 terminate with a narrow portion that extends into annular channels 3B of the second winding roller 3. The layout is analogous to the one described in WO-A-9421545, the content of which may be referred to for greater details concerning the construction of this rolling surfaces.

The rolling surface 15 forms, with the external cylindrical surface of the winding roller 1, a channel 19 to feed the tubular winding cores. The channel 19 extends from an inlet area 21 to the nip 6 between the winding rollers 1 and 3. It has a height, in a radial direction, equal to or slightly less than the diameter of the tubular winding cores, which must be sequentially fed into the winding area in the manner described below.

In practice, the channel may increase gradually in height from the inlet to the outlet, to facilitate the increase in the diameter of the log in the first winding phase, when the first turns of web material are wound around the tubular core that rolls in the channel. For example, the height of the channel may be slightly less than the diameter of the winding core at the inlet of the channel and slightly more than it at the level of the outlet.

The tubular winding cores are carried to the inlet 21 of the channel 19 by a conveyor 23 comprising two or more flexible elements parallel with one another and equipped with pushers 25 that pick up each single tubular winding core A (A1, A2, A3, A4) from a hopper or other container, not shown. Along the path of the cores A1-A4 carried by the conveyor 23 is a glue dispenser, indicated as a whole with 29, of a per se known type, which applies a longitudinal band of glue, continuous or broken, to each of the tubular cores traveling over it. It must be understood that other conveying and gluing systems may be used to convey the tubular winding cores and to apply glue to them, preferably along longitudinal lines, that is parallel to the axis of said cores.

In the layout in FIG. 1 the tubular winding cores A2 and A3 have already been equipped with a longitudinal band of glue, indicated with C. This band may be broken in positions corresponding to the positions in which the strips 17 and the pushers 25, with the respective chains carrying them, are disposed.

The tubular winding core A2 is in proximity to the inlet 21 of the channel 19 and was fed by an auxiliary feeder 30 of a per se known type (see for example WO-A-9421545) or in any other suitable way, for example by a sudden movement of the conveyor 23 and through the effect of the thrust of the pusher 25. The auxiliary feeder 30 may be constituted with a comb structure to penetrate between the strips 17. The longitudinal band of glue C may be broken even at the level of the teeth forming the structure of the auxiliary feeder 30.

The log L1 formed around the tubular core A1 is in the completion phase. In an intermediate position, along the extension of the channel 19 is a severing element 31 that rotates around an axis of rotation 31A parallel to the axis of the winding rollers 1, 3, 5. In the position of FIG. 1 the end of the severing element 31 is in contact with the web material N in an intermediate position along the arc of contact of the material with the winding roller 1. In the contact point with the severing element 31 the web material N is pinched between this element and the winding roller 1.

The peripheral speed of the severing element 31 is greater than the peripheral speed of the winding roller 1 and therefore than the feed speed of the web material N. The latter is thereby drawn and tensioned in the portion between the point pinched by the severing element 31 and the point pinched by the tubular core A2. Tensioning causes the web material N to slide on the external surface of the winding roller 1 and finally tearing of the web material N along a perforation line produced by the perforator 13 and disposed between the new core A2 and the contact point with the severing element 31. Sliding of the material can be facilitated by the presence of annular bands with a low coefficient of friction on the cylindrical surface of the winding roller 1.

In practice, the severing element 31 is constituted by a series of teeth or slats parallel with one another and integral with a center body rotating around the axis 31A. Each of said teeth or slats passes between adjacent strips 15 in order to pass through the channel 19.

Each of the teeth or slats forming the severing element 31 is equipped at its end with a pad 41 impregnated with glue. When the pad 41 is pressed against the web material N it applies to it part of the glue with which it is impregnated. Consequently, a broken longitudinal band C2 of glue is applied along the crosswise extension of the web material N.

Figure 2:
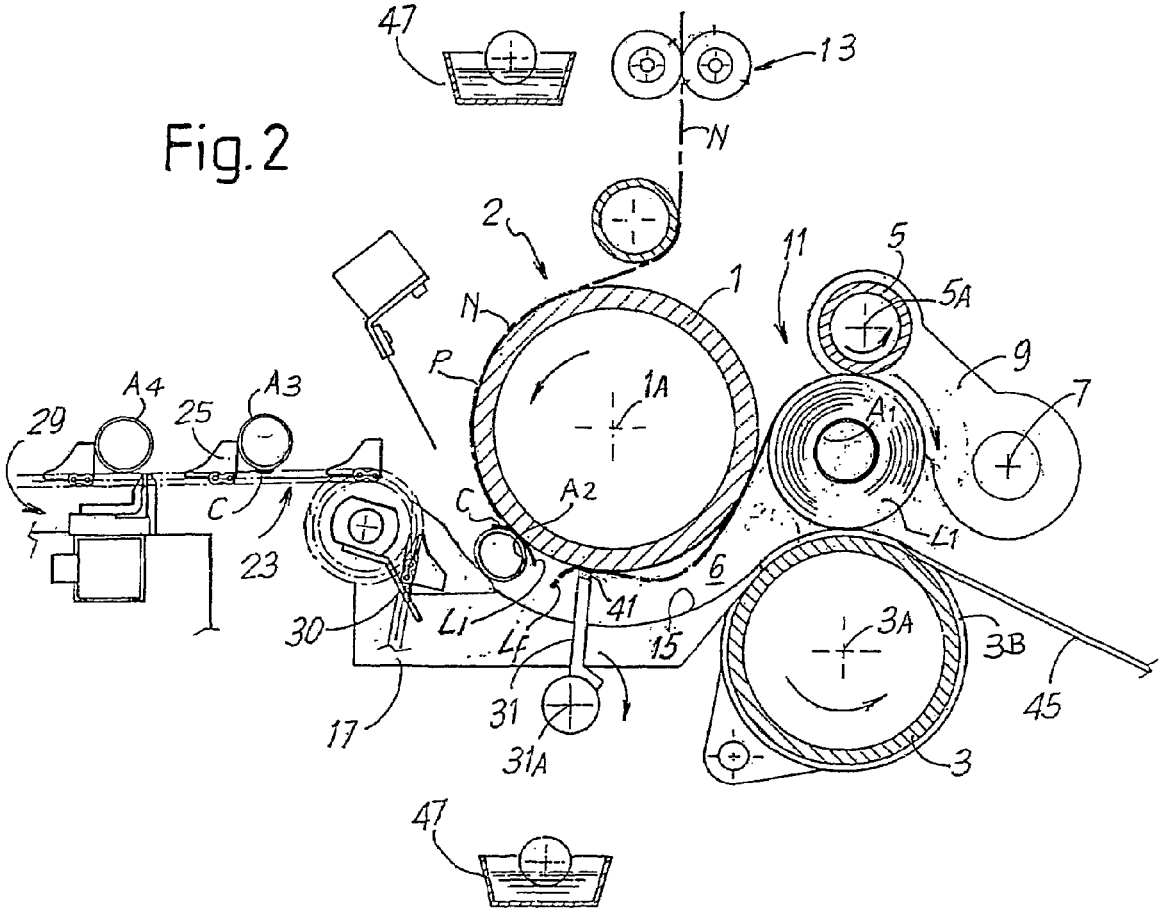

FIG. 2 shows a successive phase of the operating cycle of the rewinding machine. In this phase the web material N has been torn between the contact point with the severing element 31 and the new winding core A2 fed into the channel 19. The core A2 is rolling along the channel 19, in contact with the fixed rolling surface 15 and the rotating surface of the winding roller 1. The free edge L1 that was formed following severing adheres to the tubular core A2 thanks to the band of glue C, while the free edge Lf, which constitutes the final edge of the log L1, will be glued to the log L1, by the band of glue C2 applied by the pads 41 in the manner described hereunder.

Figure 3:
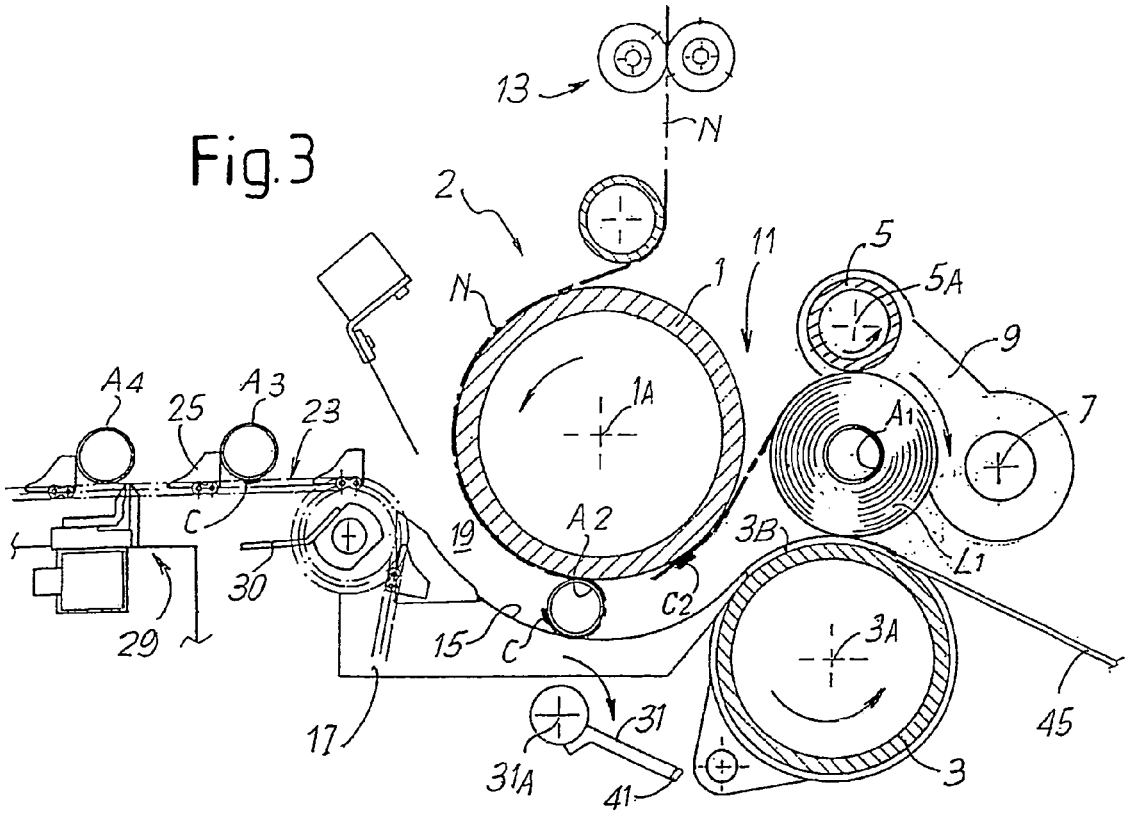

FIG. 3 shows a subsequent phase wherein the severing element 31, continuing its rotatory movement around the axis 31A, has left the channel 19, while the core A2, on which the first turn of web material is being wound, d, moves towards the nip 6 between the winding rollers 1 and 3. The finished log L1 starts to move away from the winding cradle by means of a variation in the peripheral speed between the rollers 3 and 5, for example by acceleration of the roller 5 and/or deceleration of the roller 3.

To make the final free edge Lf adhere to the periphery of the finished log, this is made to rotate between the two rollers 3 and 5, through appropriate control of their peripheral speeds. By making the log L1 make at least one complete turn in this position the final free edge Lf is pressed against the log and glued to it.

After the web material has been severed and before the final free edge adheres completely to the finished log, the tail portion of the web material adheres lightly to the winding roller 1 through the aerodynamic effect and also due to the presence of annular areas of material with a high coefficient of friction that in a per se known way are provided on the cylindrical surface of the roller 1 and tend to hold the web material N.

The difference in peripheral speed between the rollers 3 and 5, after adhesion of the final free edge Lf to the finished log L12, will unload the log to an unloading surface 45. To allow ejection of the log the upper winding roller 5 is raised and subsequently lowered to come into contact with the new log L2 to be formed in the subsequent cycle.

Figure 4:
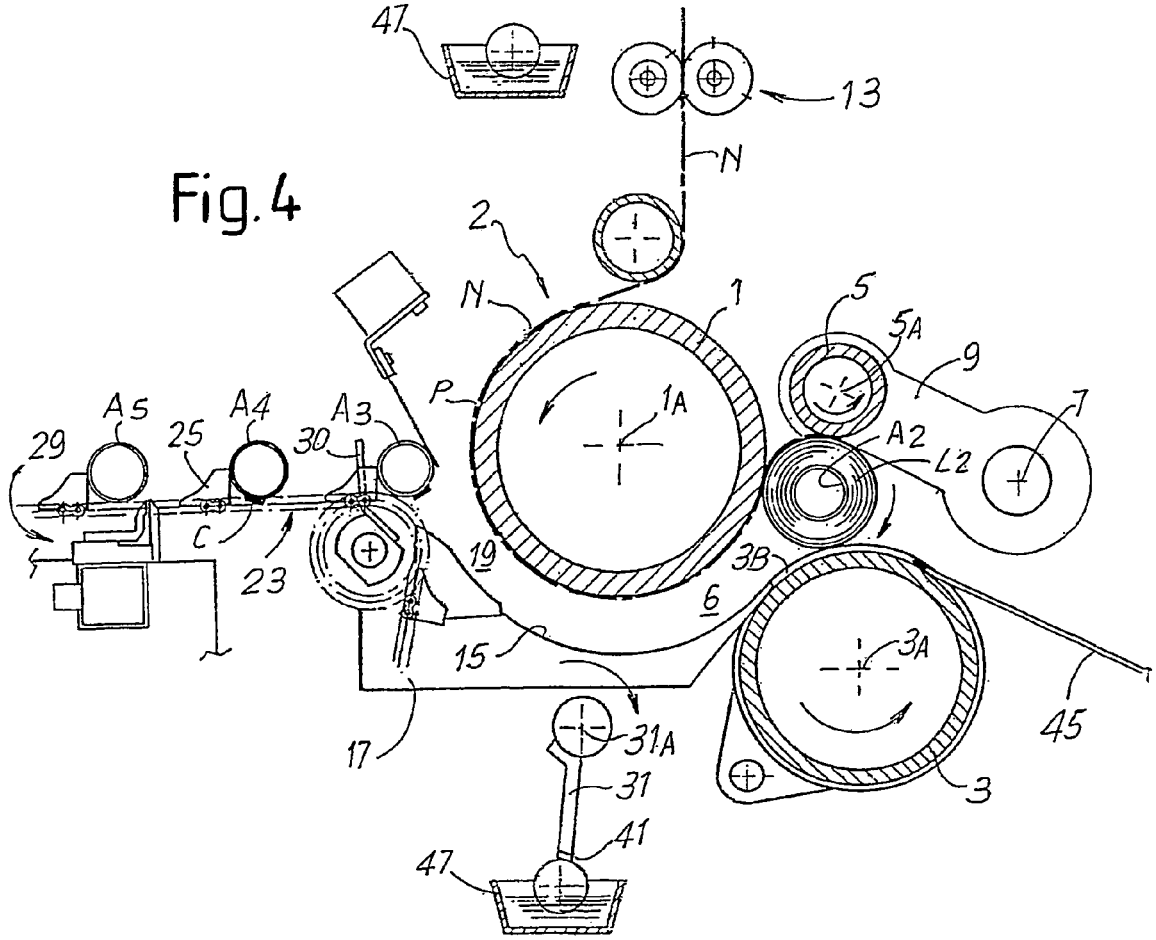

FIG. 4 shows a moment during winding of the new log L2 of web material around the tubular core A2 that has reached the winding cradle between the rollers 1, 3 and 5. The roller 5 has been lowered and is in contact with the log L2 being formed. It will oscillate gradually upwards to allow increase in the diameter of the log. The log L1 has been completely unloaded, while the new core A3 has reached a stand-by position to be fed at a subsequent moment (when the log L2 has been completed) into the channel 19 by the pusher 30.

FIG. 4 also shows how the pads 41 carried at the ends of the teeth or slats forming the severing element 31 are soaked with glue. For this purpose they are brought into contact with a glue applicator, indicated as a whole with 47. In the example shown this applicator has a glue tank inside which a pick-up roller rotates, partially immersed in the glue contained in the tank. Other solutions are naturally possible, such as a system of nozzles, a slit to deliver glue by overflow or the like. The severing element may remain in this angular position during winding of the log L2 and only recommence its rotatory movement just before the log L2 is completed.

In this embodiment glue is applied by the severing element 31 that severs, i.e. tears the web material. This on the one hand simplifies the structure of the machine, as gluing takes place without providing an additional mechanical element, but using for this purpose (with appropriate modifications) an element already present for other operations. On the other hand this solution makes it possible to maintain, during the exchange phase, that is the phase to sever the web material, unload the log and commence a new winding cycle, an essentially continuous feed speed of the web material.

Figure 5:
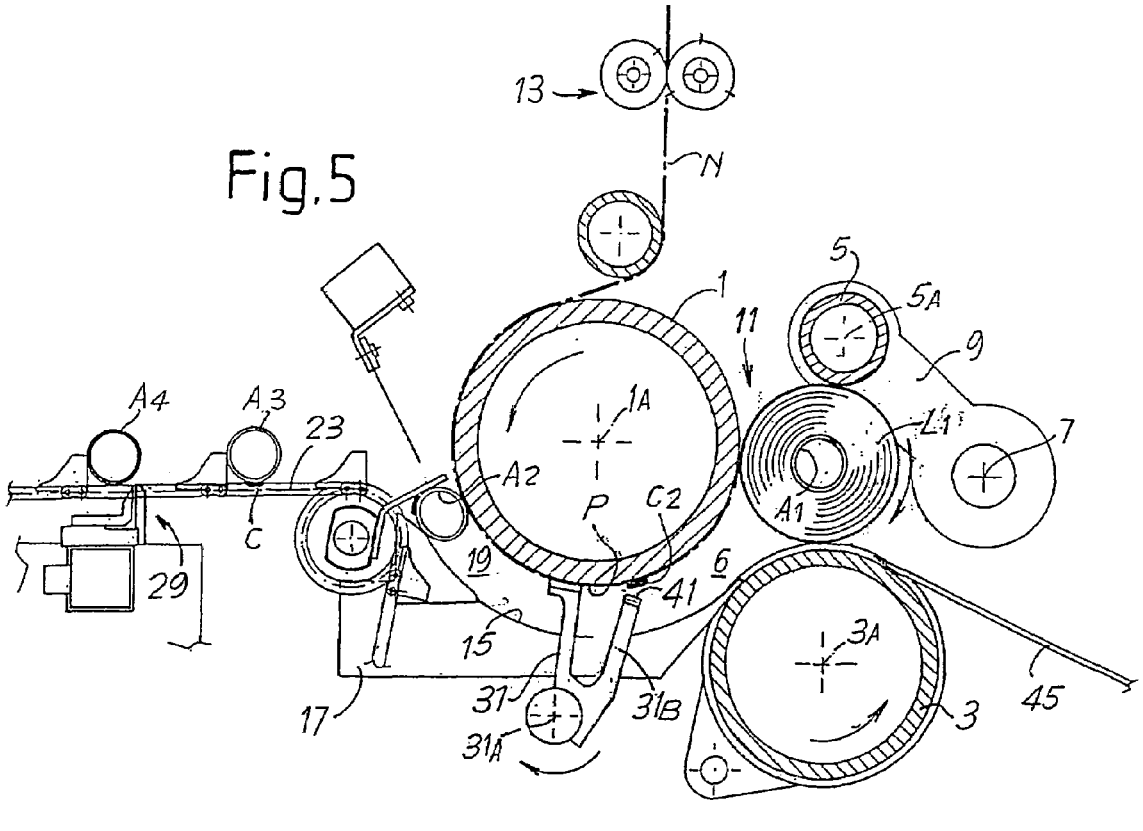
FIGS. 5 to 7 show a second embodiment of the rewinding machine according to the invention in three different moments of the winding cycle, again in a schematic side view.
Figure 6:
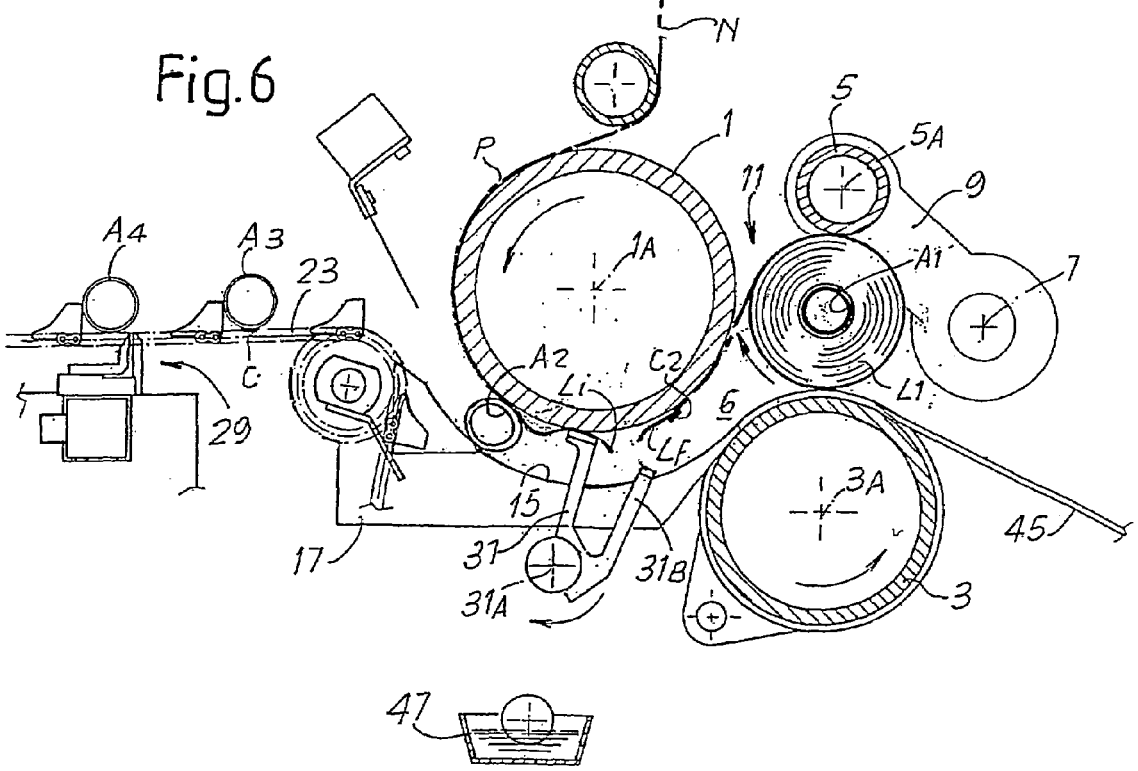
Figure 7:
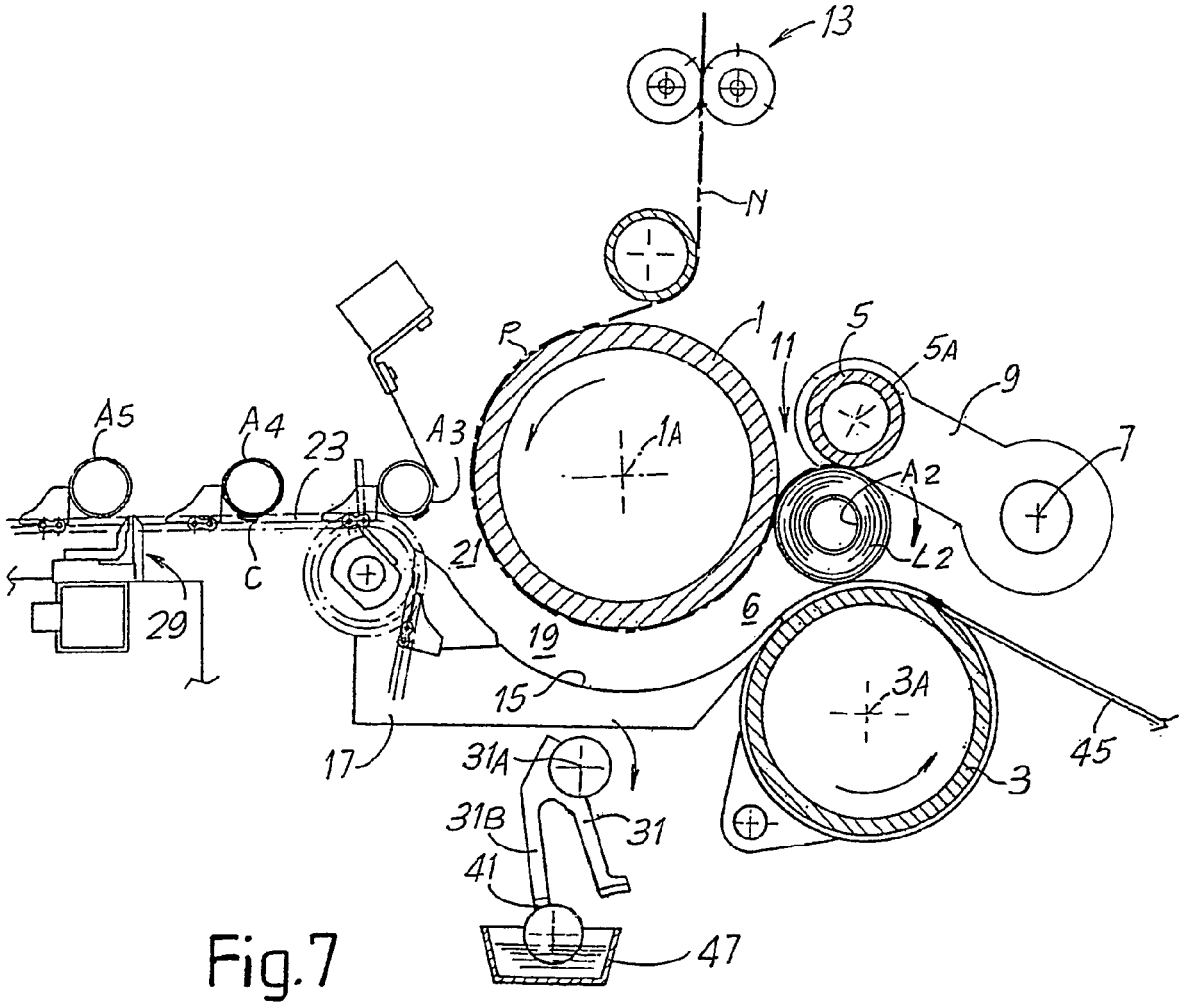

FIGS. 5, 6 and 7 show—in different operating positions—an embodiment modified in respect of the one shown in FIGS. 1-4. Equal numbers indicate parts equal or corresponding to those in the previous embodiment. In this case the severing element, once more marked with 31, does not operate directly as a glue applicator, but has an assembly of rods 31B integral with it, at the ends of which pads 41, destined to be soaked with glue, are integral. When the severing element is in the operating position, as shown in FIG. 5, the pads 41 are in a position further forward in respect of the severing element 31, that is downstream of it in respect of direction of feed of the web material N, and no longer in contact with said web material. With this layout severing of the web material N can be obtained in a point between the finished log L1 and the point in which the web material N is pinched between the severing element 31 and the winding roller 1. This is obtained by operating the severing element 31 at a lower peripheral speed than the peripheral speed of the winding roller 1. By suitably phasing movement of the severing element 31, and thereby of the glue dispenser 31B, 41, with the position of the perforation lines produced on the web material by the perforator unit 13 it is possible to make the web material tear along a perforation line that is positioned between the point in which it was touched by the pads 41 and the point in which it is pinched by the severing element 31. This solution is particularly advantageous due to the reduced rotation speed of the severing element 31 and of the glue dispenser 31B integral with it. The lower rotation speed reduces the centrifugal effect on the glue with which the pads carried by the dispenser 31B are soaked and this makes it possible to increase the feed speed of the web material N without the risk of the glue, owing to the centrifugal force, being sprayed from the dispenser 31B.

On the contrary, relinquishing this advantage, also in this embodiment the severing element 31, and therefore the glue dispenser 31, can be made to move at a higher peripheral speed than the peripheral speed of the winding roller 1, causing the web material N to tear or be severed upstream of the point in which it is pinched, as described with reference to the previous embodiment.

The glue is applied to pads 41 with a roller applicator, indicated as a whole with 47. Differently to the description in the previous example, in this case the glue applicator roller is provided with a movement to move it towards and away from the axis of rotation 31A of the unit formed by the severing element 31 and the dispenser element 31B, 41. In this way glue is not applied to the severing element 31. The alternate movement of the glue applicator roller may be relatively slow, as it must only act once for each turn of the unit 31, 31B around the axis 31A, which takes place once during each winding cycle, i.e. for each log produced.

According to an alternative embodiment, not shown, the position of the elements 31 and 31B can be inverted, in which case the web material N will be severed necessarily upstream of the point in which it is pinched by the severing element 31, moving this at a higher peripheral speed to the peripheral speed of the winding roller 1 in the severing phase. In this case tearing or severing of the web material will preferably take place after having applied the glue C2 to it to seal the final free edge Lf of the log. This is due to the fact that the point in which glue is applied is weakened by the liquid content of the glue, which, (in the case of paper web material) reduces the mechanical resistance to traction. This could cause the web material to tear at the level of the line of glue C2 instead of at the level of the perforation line along which tearing has been programmed.

FIGS. 8 to 11 show, in different operating positions, a further embodiment of the machine according to the invention. Equal numbers indicate equal or corresponding parts to those in the previous embodiments. Extending upstream of the nip 6 between the winding rollers 1 and 3 is a rolling surface, indicated once more with 15, which may be constituted by a series of strips or by a continuous section bar and which extends to a lesser extent than the rolling surface 15 of the previous embodiments.

Disposed underneath the inlet of the channel 19 formed between the surface of the winding roller 1 and the rolling surface 15 is a hopper 81 inside which the winding cores A1-A4 are fed in sequence, already provided with a longitudinal band (continuous or broken) of glue C. The cores may be introduced, for example, with a longitudinal movement. A pusher 83, oscillating around an axis 83A parallel to the axes 1A, 3A, 5A of the winding rollers 1, 3, 5 picks up the core that is positioned time by time in the hopper 81 and feeds it into the channel 19 between the rolling surface 15 and the cylindrical surface of the winding roller 1. The dimension of the channel is equal to or slightly less than the external diameter of the tubular core, which is thereby forced into the channel 19 and made to roll on the fixed surface 15 through the effect of the rotatory movement of the winding roller around which the web material N is fed, which is pinched between the core and the roller 1.

Alternative solutions to feed the winding cores into the channel 19 are naturally possible. For example the cores may be fed by means of a feeder equipped with a hypocycloid movement or with any other known system. Preferably, they will in any case be equipped with a longitudinal band of glue C, although the use of annular bands of glue is not excluded a priori, which may also be adopted in the other embodiments described. In this second case the rolling surface 15, as in the previous examples, will preferably not be continuous, to prevent part of the glue from remaining attached and accumulating on it.

Upstream of the inlet to the channel 19, along the feed path of the web material N, is a glue dispenser indicated as a whole with 85. It comprises one or more slats 87 rotating around an axis 89, parallel to the axis of rotation of the winding roller 1, 3, 5. At the end of the rod or of each rod 87 is an absorbent pad 88, which is soaked with glue, picked up from a glue applicator 91 analogous to the applicator 47. The dispenser 85 makes one turn for each winding cycle, that is for each log L produced by the machine. It is disposed so that the pads 88 touch the web material N fed around the winding roller 1 to leave on it a quantity of glue sufficient to make the free edge of the web material adhere to the completed log. In the moment of reciprocal contact, the web material N and the pads 88 have the same speed, so as to avoid any damage to the web material N.

In this embodiment the glue dispenser 85 is in an area with ample space available and not provided with a rolling surface for the core. It is therefore possible to design the glue dispenser in other ways to allow the use of a non-liquid glue. For example, the glue may be composed of a double-sided adhesive strip, and the glue dispenser may have a system for unwinding lengths of double-sided adhesive tape and applying them to the web material.

Figure 8:
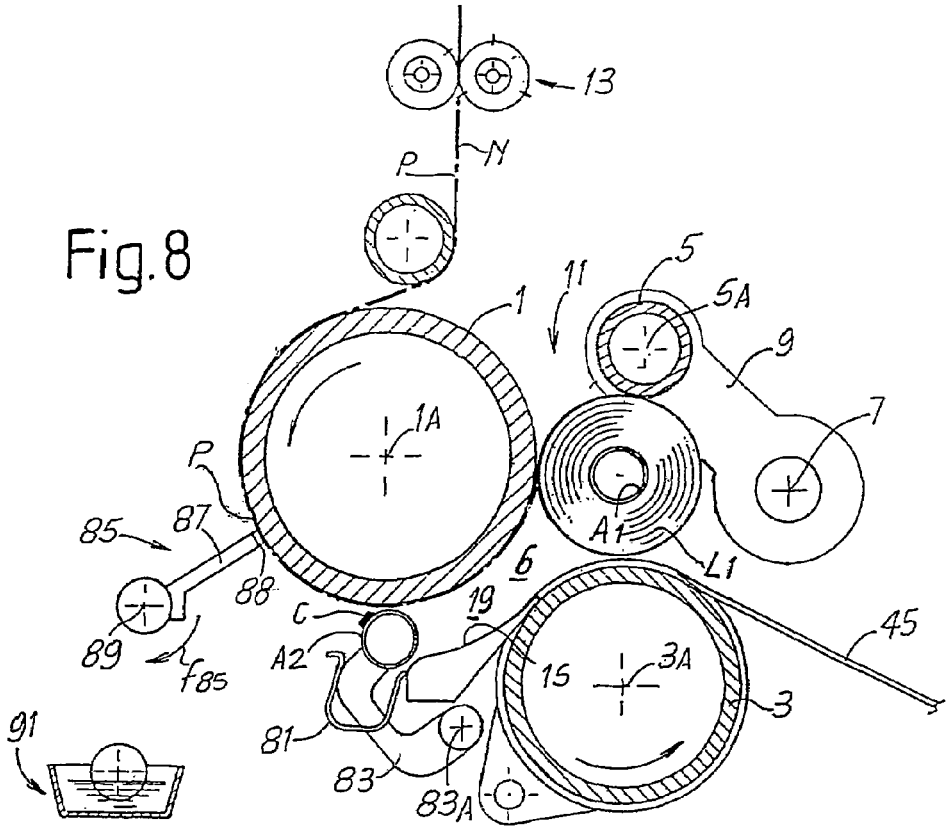
FIGS. 8 to 11 show a third embodiment of the rewinding machine according to the invention in four different moments of the winding cycle, again in a schematic side view.

Operation of the machine in this embodiment is clearly shown in the sequence in FIGS. 8 to 11. In FIG. 8 the log L1 has been practically completed and the subsequent winding core A2 destined to form the subsequent log, equipped with glue C, has been partially raised from the hopper 81 by the pusher 83. It is positioned in front of the inlet of the channel 19 but has not yet been brought into contact with the web material N and with the surface 15.

The dispenser 85 is rotating clockwise according to the arrow f85, so that the pads 88 come into contact with the web material N, moving at the same speed as it, to deposit a band of glue on it. This is applied downstream of a perforation line, produced by the perforator 13 and indicated with P, along which the web material will be torn.

The roller 5 is temporarily accelerated so as to tension the web material N. This acceleration commences at a suitable moment, if necessary before the new core A2 is fed to facilitate tearing of the web material, which takes place as described hereunder.

Figure 9:
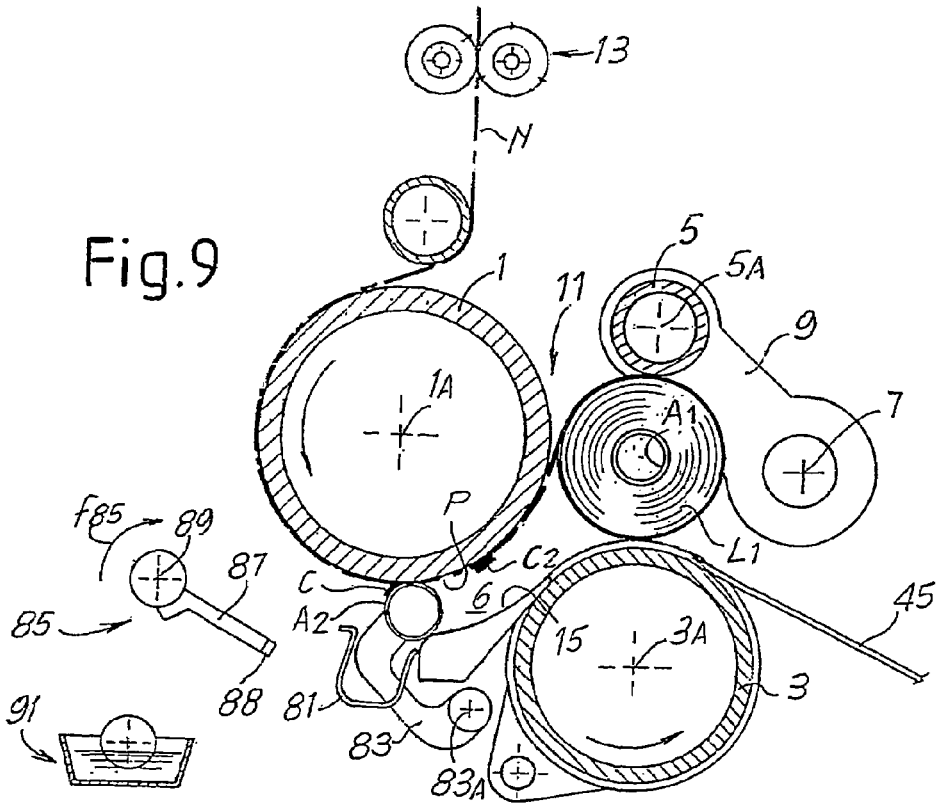
Figure 10:
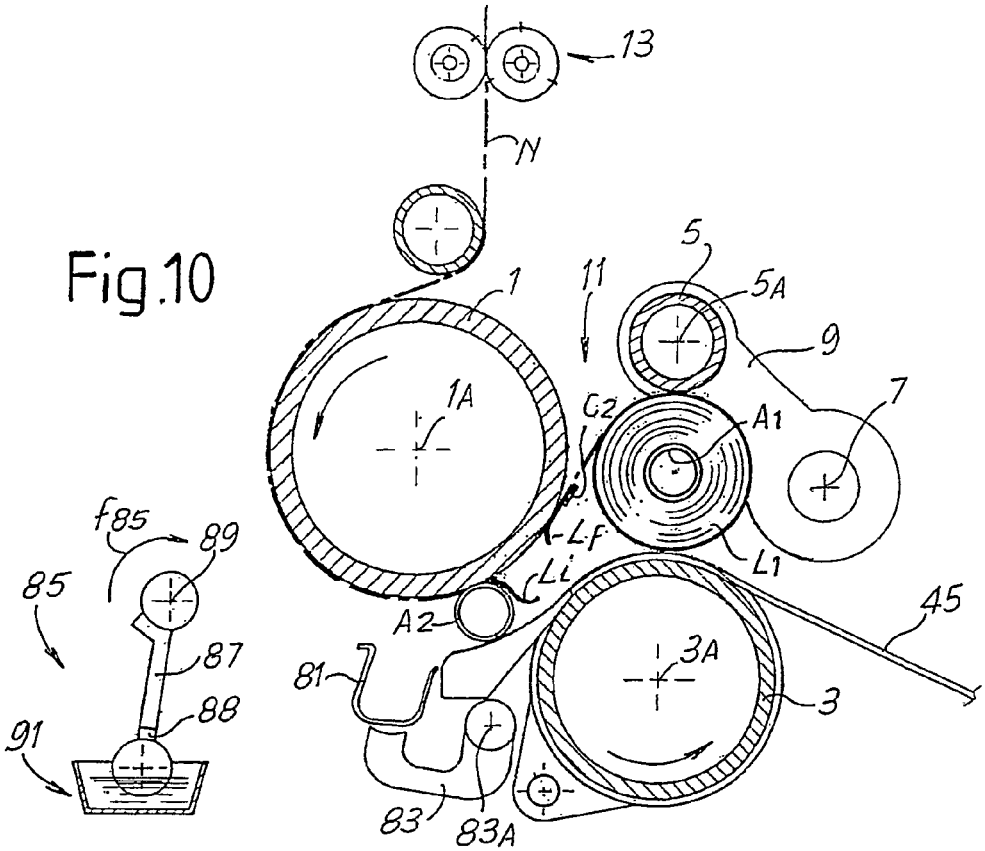
Figure 11:
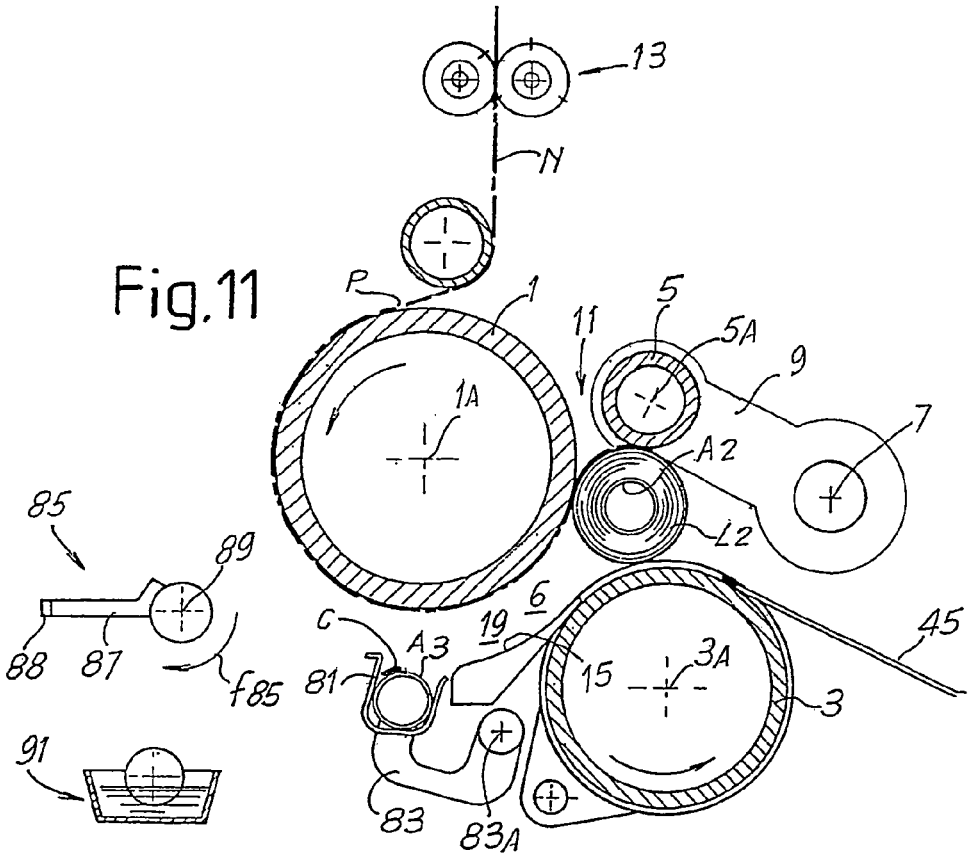

In FIG. 9 the glue dispenser 85 is no longer in contact with the web material N while the winding core A2 has been fed into the channel between the rolling surface 15 and the winding roller 1, so that the web material N is pinched between the core A2 and the roller 1. The core A2 starts to roll along the surface 15, while acceleration of the winding roller 5 increases the tension of the web material between the contact point of the roller with the log formed L1 and the point in which the web material is pinched by the new tubular winding core A2. Acceleration of the roller 5 is controlled so that it causes the web material to tear along the perforation P when this is between the core A2 and the log L1, as shown in the position in FIG. 10. The final free edge Lf that is produced is provided with the band of glue C2 applied by the dispenser 85. It continues to wind around the finished log L1, which is moved away by rolling on the surface 45, causing adhesion of the free edge Lf and consequently sealing the log L1. The initial free edge Li remains fastened to the new winding core A2 due to the glue C applied to it. The core A2 continues to roll on the surface 15 until it reaches the nip 6 and subsequently the winding cradle defined by the rollers 1, 3 and 5 where formation of a new log L2 is completed, as shown in FIG. 11. This figure also shows a subsequent winding core A3 positioned in the hopper 81 to be fed to the machine by the feeder 83 during the subsequent exchange cycle.

The embodiment in FIGS. 8 to 11 makes it possible to apply a continuous line of glue both to the cores and to the web material.

FIGS. 12 to 15 show yet another embodiment of the invention. Equal numbers indicate equal or corresponding parts to those in the embodiment in FIGS. 1 to 4.

Also in this case the rewinding machine, indicated once again as a whole with 2, comprises a first winding roller 1, rotating around an axis 1A, a second winding roller 3, rotating around a second axis 3A parallel to the axis 1A, and a third winding roller 5, rotating around an axis 5A parallel to the axes 1A and 3A and moving around an axis 7 of oscillation, around which oscillating arms 9 to support the winding roller 5 are supported. The three winding rollers 1, 3 and 5 define a winding cradle 11 inside which, in the position shown in FIG. 12, a first log L1 of web material is found in the final phase of winding.

A nip 6 is defined between the winding rollers 1 and 3 through which the web material N passes and is wound around to form the log L1. The web material N is fed around the first winding roller 1 and, before reaching it, through a perforator unit 13 that perforates the web material N along the perforation lines equidistant and substantially orthogonal to the direction of feed of the web material. In this way the web material N wound on the log L1 is divided into sheets that can be separated individually by being torn by the final user.

A rolling surface 15, essentially concave cylindrical and coaxial to the winding roller 1, extends around a portion of said winding roller 1. The rolling surface 15 is formed by a series of parallel strips 17, which terminate with a narrow portion that extends into annular channels 3B of the second winding roller 3.

The rolling surface 15 forms, with the external cylindrical surface of the winding roller 1, a channel 19 to feed the tubular winding cores. The channel 19 extends from an inlet area 21 to the nip 6 between the winding rollers 1 and 3. It has a height, in a radial direction, equal to or slightly smaller than the diameter of the tubular winding cores. In practice, as specified with reference to the first embodiment, the height of the channel may be variable and increasing from the inlet towards the outlet. In practice, however, the length of the rolling surface 15 and thereby of the channel formed by it with the winding roller 1 may be smaller than shown in the appended figures, as this embodiment does not include a severing element for the web material that must operate along the extension of the channel.

The tubular winding cores are brought in proximity to the inlet 21 of the channel 19 by a conveyor 23 comprising two or more flexible elements parallel with each other and provided with pushers 25. Disposed along the path of the cores A1-A4 conveyed by the conveyor 23 is a glue dispenser, indicated as a whole with 29, of a per se known type, which applies a longitudinal band of glue, continuous or broken, indicated with C, to each of the tubular cores passing over it. This band may be broken in positions corresponding to the positions in which the strips 17, forming the rolling surface 15, are disposed.

Figure 12:
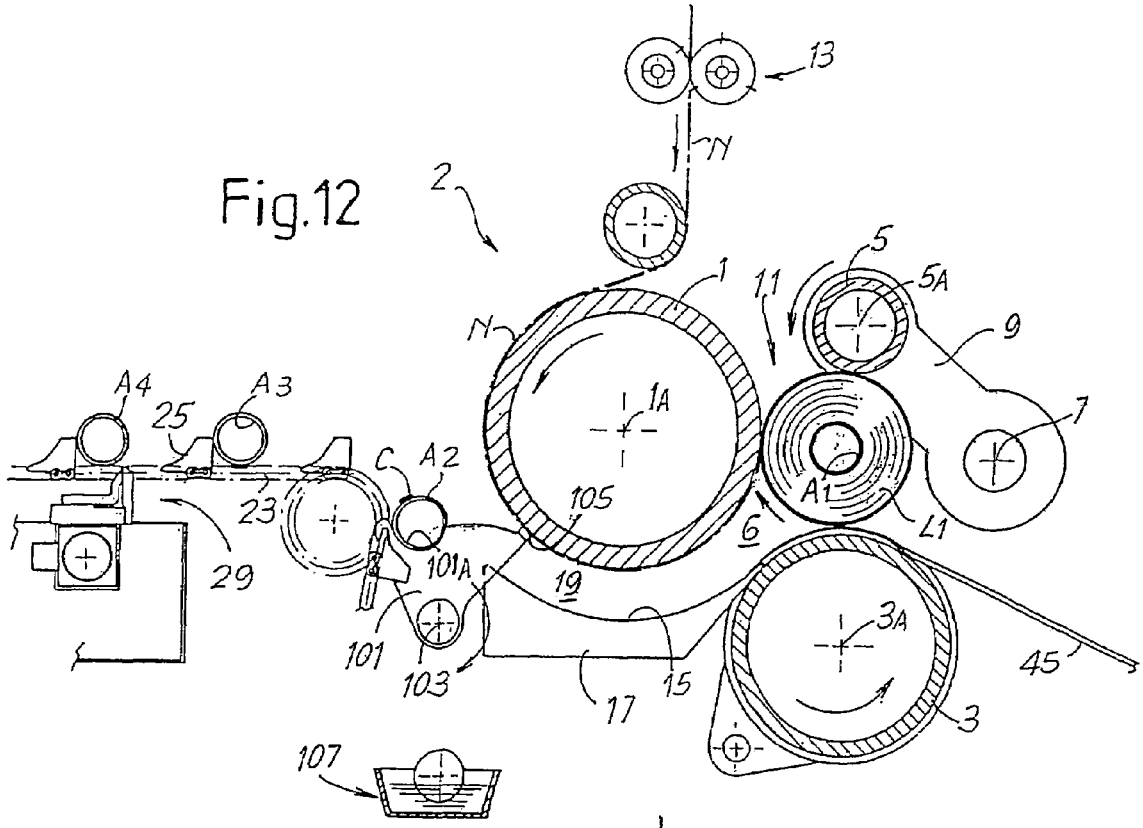
FIGS. 12 to 15 show a fourth embodiment of the rewinding machine according to the invention in four different moments of the winding cycle, again in a schematic side view.

In the, position in FIG. 12, the log L1 formed around the tubular core A1 is in the completion phase in the winding cradle 11. A new winding core A2 is ready to be fed into the channel 19, in front of the inlet 21. The core A2 is contained in a feeder 101 equipped with a seat 101A to hold the winding cores and rotating around an axis 103 parallel to the axis 1A of the winding roller 1. The feeder 101 has a comb structure so as to penetrate, in its rotatory movement around the axis 103, between the strips 17 forming the rolling surface 15, for the purposes explained hereunder. The individual winding cores are unloaded in the seat 101A of the feeder by the conveyor 23.

In front of the seat 101A the feeder is provided with a series of pads 105 soaked in glue, which in the rotatory movement of the feeder 101 come to touch the web material N fed around the winding roller 1 to apply the glue destined to seal the final free edge of the completed log to it. The glue is applied to the pads 105 by a glue applicator 107 analogous to the one described with reference to FIGS. 5 to 7. The contact pressure of the pads 105 on the web material is minimum and their relative speed in respect of the web material is null, as it is not the duty of these pads to break or sever the web material N.

Operation of the machine is clearly shown in the sequence in FIGS. 12 to 15. In FIG. 12 the feeder 101 is rotating around the axis 103 at a peripheral speed that makes the pads 105 move at the same speed as the web material N and therefore at the same peripheral speed as the winding roller. The winding roller 5 may already be accelerating or may be accelerated at a slightly later moment, to start the operation to unload the log L1 and to tension the web material N prior to severing. In the example shown, acceleration of the roller 5 has already commenced, and the log L1 has already been moved slightly away from the surface of the winding roller 1, with which it was in contact in the previous winding phase. Detachment of the log L1 from the roller 1 may also take place through the effect of deceleration of the lower roller 3, or through the combined effect of acceleration of the roller 5 and deceleration of the roller 3.

Figure 13:
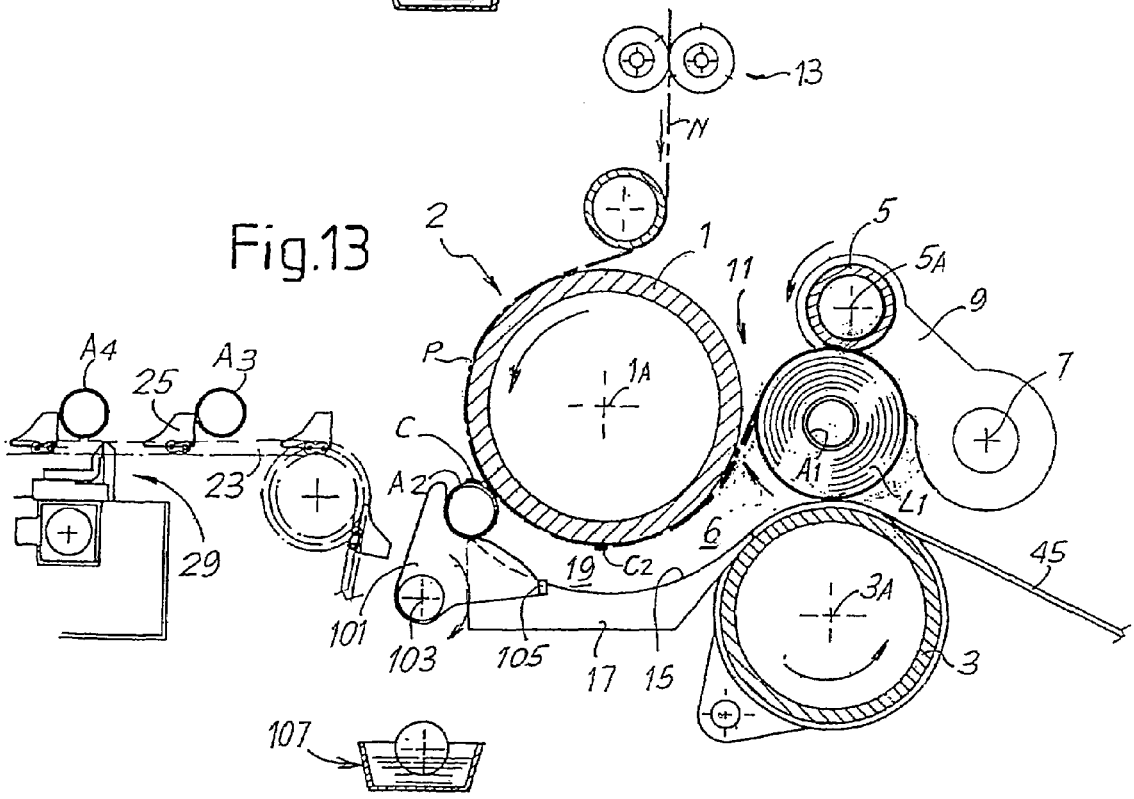

In FIG. 13 the feeder 101 has brought the core A2 inside the channel 19, in contact between the web material N and the rolling surface 15. The movement of the feeder 101 is controlled suitably so as not to obstruct the movement to feed the tubular core, which starts to roll on the surface 15 when it comes into contact with it and with the web material N fed around the winding roller 1.

The longitudinal band of glue C2 applied by the pads 105 is positioned on a portion of web material downstream of the contact point with the core A2. As the pads are discontinuous, the band C2 will be broken along its longitudinal extension. The web material between the completed log L1 and the new core A2 is tensioned gradually due to acceleration of the winding roller 5.

Figure 14:
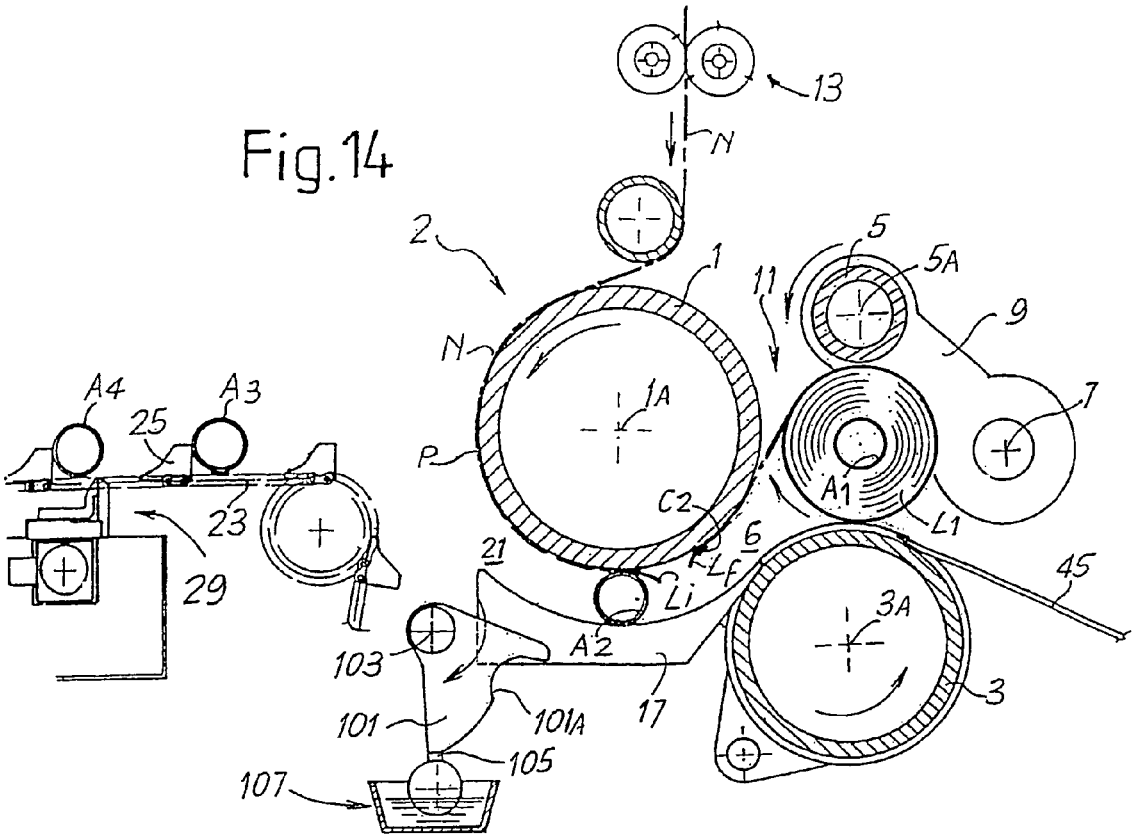

The tension produced in the web material N at a certain point causes the material to tear along a perforation line between the core A2 and the log L1, producing a final free edge Lf of the log and an initial free edge L1 that will be glued to the new core A2 by means of the glue C. This condition is shown in FIG. 14, wherein the log L1 has moved further from the winding cradle 11 and is about to be unloaded onto the unloading surface 45. The new core A2 is rolling along the rolling surface 15 and the glue C has come into contact with the web material N which adheres to it in proximity to the initial free edge L1 produced by tearing. The feeder 101 continues to rotate clockwise, to bring the pads 105 in contact with the gluing roller of the glue applicator 107 below. The feeder 101 continues to rotate until it has been brought to the stand-by position in FIG. 15. The time available for this movement is slightly less than the time required to complete the log, and therefore may be relatively slow.

Figure 15:
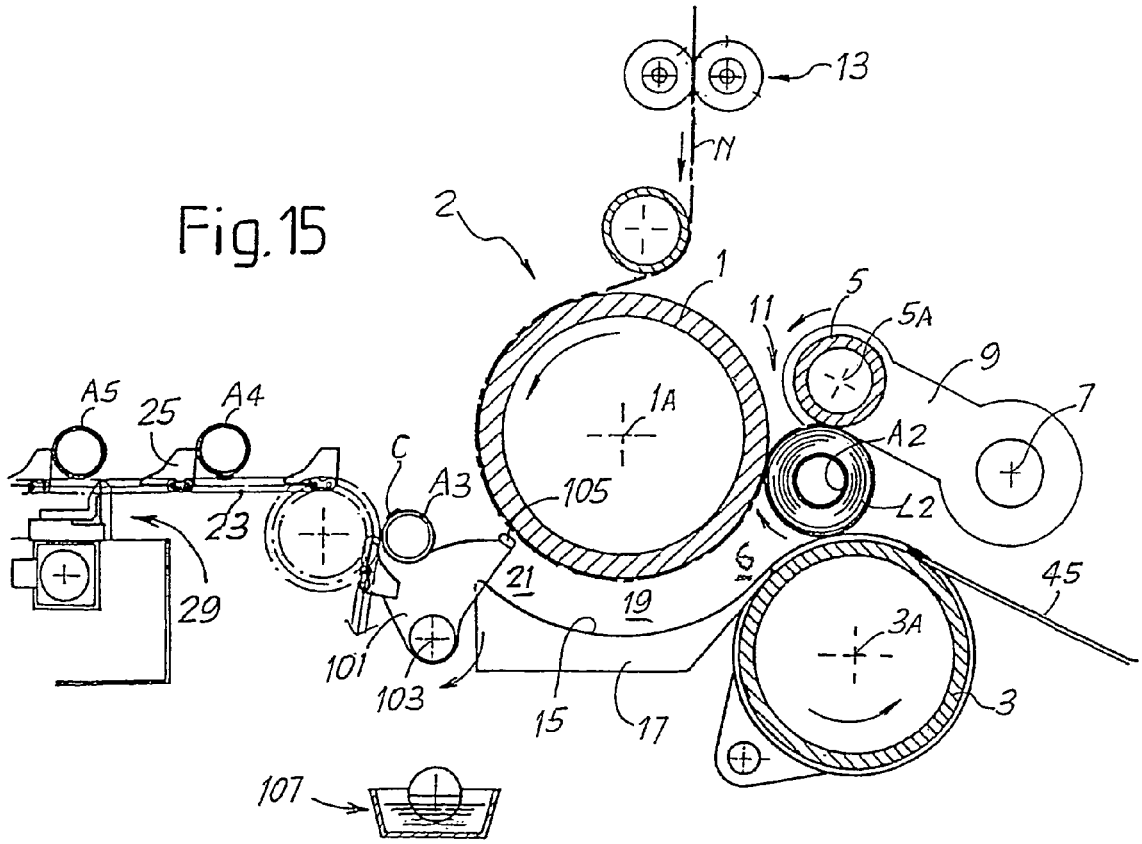

FIG. 15 shows the machine in a subsequent phase wherein the new core A2 is in the winding cradle 11 and the new log L2 has started to form around it. A subsequent winding core A3 has in the meantime been unloaded into the seat 101A of the feeder, to be fed to the machine during the next exchange cycle, when the log L2 has been completed.

In a different development of the inventive concept, the core is utilized as a mechanical element to transfer the glue. FIGS. 16 to 20 show an example of this development. In practice, a rewinding machine is provided to produce logs of wound web material, comprising:

- winding elements to wind the web material and form said logs;
- a severing element to sever the web material upon termination of winding each log, to form a final edge of the finished log and an initial edge of a subsequent log;
- a feeder to feed tubular winding cores towards said winding elements;
- at least a first glue dispenser to apply a first glue to said winding cores, according to at least a longitudinal band,
- said feeder and said severing element being arranged and controlled so that upon termination of winding each log, the web material is severed and said longitudinal band of glue applied to said core is brought into contact with said web material after it has been severed, so that at least part of the glue is transferred to the web material in the vicinity of the final free edge of the finished log, said first glue gluing the final free edge of the log.

With this rewinding machine it is possible to implement a method to produce rolls of wound web material, comprising the phases of:

winding a quantity of web material around a first winding core to form a first log in a winding area;

upon termination of winding said first log, severing the web material to produce a final edge of the first log and an initial edge to form a second log;

applying a first glue to a second winding core, said glue being applied according to at least a longitudinal band essentially parallel to the axis of said core;

after severing of said web material, bringing said longitudinal band of glue applied to the second core into contact with said web material;

transferring at least part of the first glue from said core to said web material, in proximity or at the level of said final free edge, to close the final free edge of the first log.

Having thus defined the general concepts underlying this layout, a practical embodiment is described with reference to FIGS. 16 to 20 and in particular with initial reference to FIG. 16. The rewinding machine, indicated as a whole with 2, comprises a first winding roller 1, rotating around an axis 1A, and a second winding roller 3, rotating around a second axis 3A parallel to the axis 1A. A third winding roller 5, rotating around an axis 5A parallel to the axes 1A and 3A is also provided. The third winding roller 5 is supported by oscillating arms 9.

The three winding rollers 1, 3 and 5 form a winding cradle. A nip 6 is defined between the rollers 1 and 3, fed through which is the web material N to be wound, which is fed around the winding roller 1. In the condition in FIG. 16, a first log L1 of web material is found in the winding cradle 1, 3, 5 in the winding phase, and the three winding rollers rotate substantially at the same peripheral speed, equivalent to the feed speed of the web material N. The log L1 is being wound around a first winding core A1.

Upstream of the winding roller 1 the web material passes through a perforator, not shown, which forms crosswise perforation lines along the material N.

A rolling surface 15, substantially concave cylindrical and essentially coaxial to the winding roller 1, extends around said winding roller 1. It is formed by a series of strips 17 parallel to and spaced apart from one another, one of which is shown in the figure and the others are parallel to it. The strips 17 terminate with a narrow portion that extends into annular channels 3B of the second winding roller 3. The layout is analogous to the one described in WO-A-9421545, the content of which may be referred to for greater details concerning the construction of this rolling surfaces.

The rolling surface 15 forms, with the external cylindrical surface of the winding roller 1, a channel 19 to feed the tubular winding cores. The channel 19 extends from an inlet area 21 to the nip 6 between the winding rollers 1 and 3. It has a height, in a radial direction, equal to or slightly less than the diameter of the tubular winding cores, which must be sequentially fed into the winding area in the manner described below. In practice, the channel may increase gradually in height from the inlet to the outlet, to facilitate the increase in the diameter of the log in the first winding phase, when the first turns of web material are wound around the tubular core that rolls in the channel. For example, the height of the channel may be slightly below the diameter of the winding core at the inlet of the channel and slightly above it at the level of the outlet.

The tubular winding cores are carried to the inlet 21 of the channel 19 by a conveyor 23 comprising two or more flexible elements parallel with one another and equipped with pushers 25 that pick up each single tubular winding core A (A1, A2, A3, A4) from a hopper or other container 26. Disposed along the path of the cores A1-A4 carried by the conveyor 23 is a glue dispenser, indicated as a whole with 29, of a per se known type, which applies a longitudinal band of glue, continuous or broken, to each of the tubular cores traveling over it, that is parallel to the axis of said cores. It must be understood that other conveying and gluing systems may be used to convey the tubular winding cores and to apply glue to them, preferably along longitudinal lines, that is parallel to the axis of said cores. In the example shown, the glue dispenser includes a tank 28 inside which the glue C is contained and inside which a moving element 34A is immerged. In the example shown the element 34A is provided with an alternate movement of immersion as it is connected to an oscillating arm 32A. Other systems may also be used to transfer glue from the tank to the core that is positioned over the tank each time. In general, the dispenser is in any case suitable to apply a longitudinal band of glue FIG. 16 also shows with a dashed line a second glue dispensing element, specular to the first, capable of applying a second band of glue to the core for the purposes described below. The two longitudinal bands of glue may also be applied by two separate dispensers that use different glues, also in view of the different technical properties the glue must have, one being destined to close the final free edge of the logs formed and the other to make the initial free edge of the web material adhere to the new core.

Disposed along the path of the conveyor 23 is a system that causes the glued cores to rotate around their axis by a determined angle. In the example schematically illustrated this is a belt 36 provided with a movement according to the arrow in the figure. This allows the glued cores to arrive at the inlet 21 of the channel 19 with the band or bands of glue in the desired position.

Figure 16:
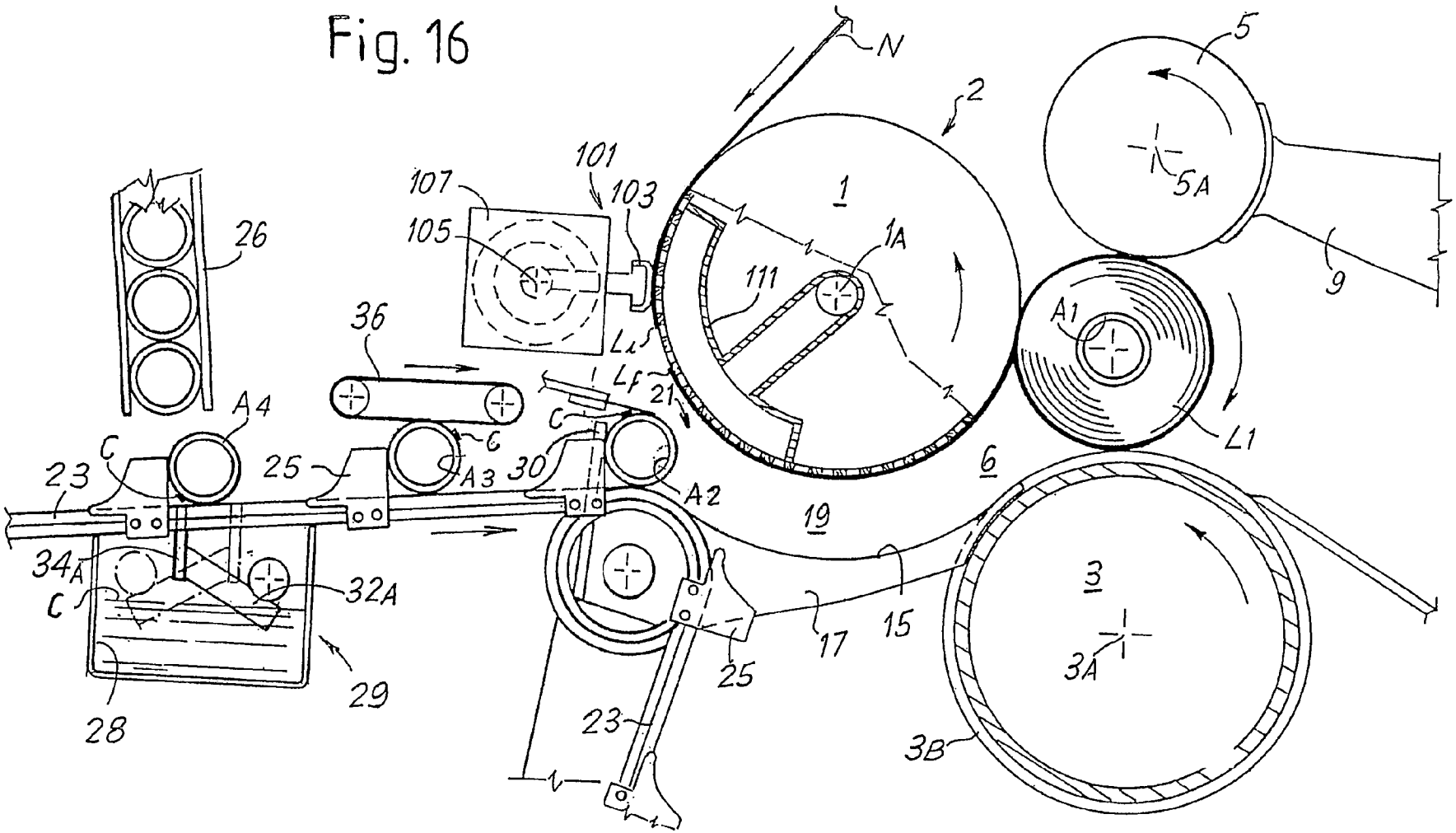
FIGS. 16 to 20 show a modified embodiment of the invention, in different operating positions of the rewinding machine.

In the layout in FIG. 16 the tubular winding cores A2 and A3 have already been equipped with a longitudinal band of glue, indicated with C. This band may be broken in positions corresponding to the positions in which the strips 17 and the pushers 25, with the respective chains carrying them, are disposed.

The tubular winding core A2 is in proximity to the inlet 21 of the channel, into which it is subsequently fed by an auxiliary feeder 30 of a per se known type (see for example WO-A-9421545) or in any other suitable way, for example by a sudden movement of the conveyor 23 and through the effect of the thrust of the pusher 25. The auxiliary feeder 30 may be constituted with a comb structure to penetrate between the strips 17. The longitudinal band of glue C may also be broken at the level of the teeth forming the structure of the auxiliary feeder 30.

Disposed upstream of the inlet 21 of the channel 19 is a severing element for the web material N, generically indicated with 101. It includes a series of pads 103 carried by an element rotating around an axis 105 by means of an actuator 107, for example an electric motor controlled electronically so that the speed and/or position of the pads 103 may be controlled accurately as a function of the position and/or speed of the remaining elements of the machine.

In the position in FIG. 16 the element 101 is in the operating condition, that is in the position in which tearing or severing of the web material starts or has started. Tearing or severing is obtained thanks to the difference in peripheral speed of the pads 103 in respect of the first winding roller 1 and in respect of the web material N fed around it. Normally, in this phase the pads 103 rotate at a speed slightly below the peripheral speed of the roller 1 and therefore below the normal feed speed of the web material N. This causes tensioning and tearing of the material N along the perforation line located immediately downstream of the area in which the web material N is pinched by the pads 103 against the winding roller 1. FIG. 16 already shows severing of the web material, with consequent forming of a final or tail edge Lf of the material, destined to be wound around the log L1 in the completion phase in the winding cradle, and an initial or leading edge L1 destined to adhere to the new core A2 that will be fed into the channel 19.

Figure 17:
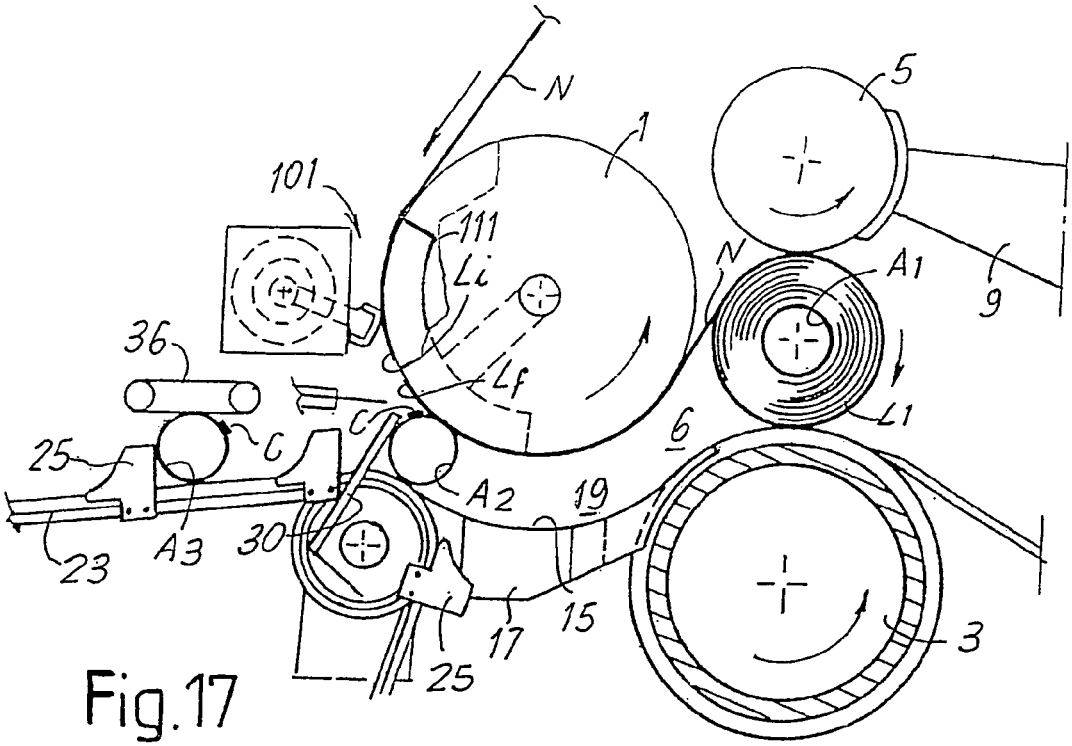

In this case, feed of the core A2 is delayed in respect of tearing the web material, as can be seen from the sequence in the subsequent FIGS. 17 to 20. It must, however, be pointed out that the moment in time in which the core is fed may differ. What is relevant is that core insertion and the angular position of the core are timed so that the glue is applied to a portion of the web material downstream of the final free edge of the completed log. In practice, the core A2 is fed into the inlet 21 of the channel 19 and therefore in contact with the web material N fed around the roller 1 after tearing or severing of the web material has already taken place. FIG. 17 shows the moment in which the core comes into contact with the web material N. As it is forced into the channel 19, it starts to roll on the surface 15 of the channel 19 and moves forward along said channel, undergoing angular acceleration.

In practice, the core may also be fed into the inlet 21 and therefore be brought into contact with the web material N before the moment in which the web material is torn or severed. However, contact between the longitudinal band of glue C and the web material N takes place after tearing of the web material and forming of the edges L1 and Lf.

The angular position of the core A2 is regulated so that it preferably comes into contact with the web material N and therefore starts to accelerate angularly rolling on the surface 15 before the band of glue C comes into contact with the web material. This allows contact between the web material N and the glue C at a moment in which there is practically no difference in speed between these two elements, thereby guaranteeing optimal transfer of glue. In fact, at least part of the glue C is in this phase transferred from the core A2 to the web material N in proximity or adjacent to the final free edge Lf. This quantity of glue guarantees subsequent closing by gluing the final free edge on the finished log L1.

Figure 18:
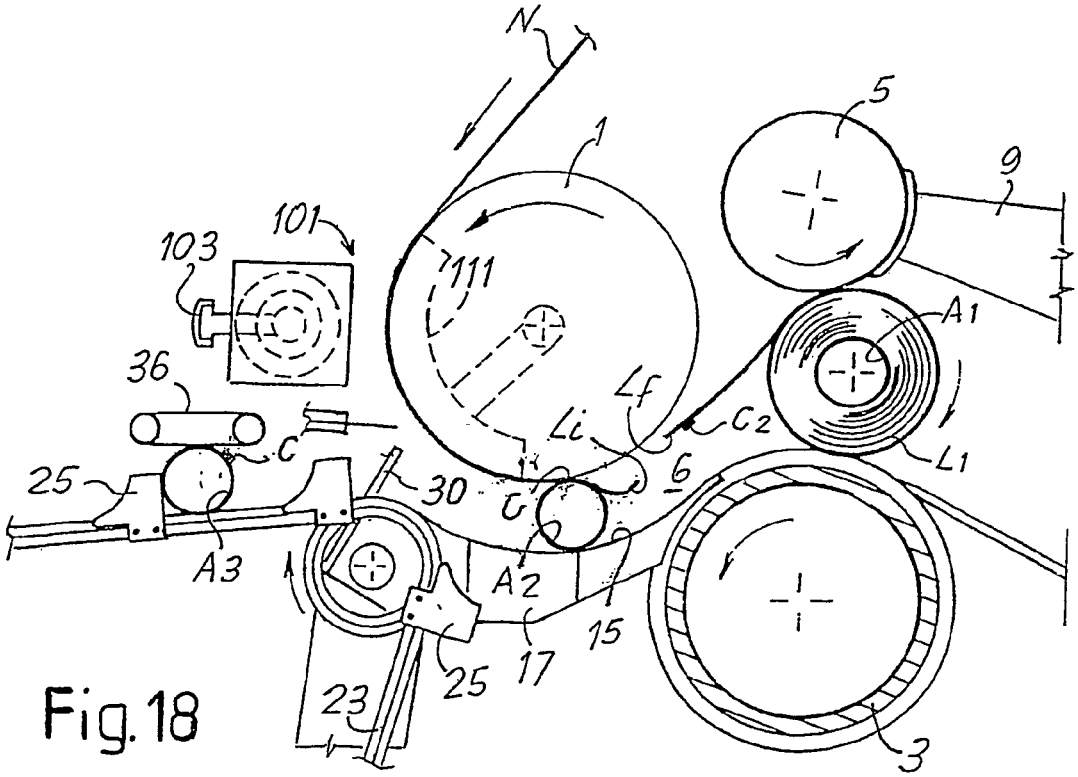
Figure 19:
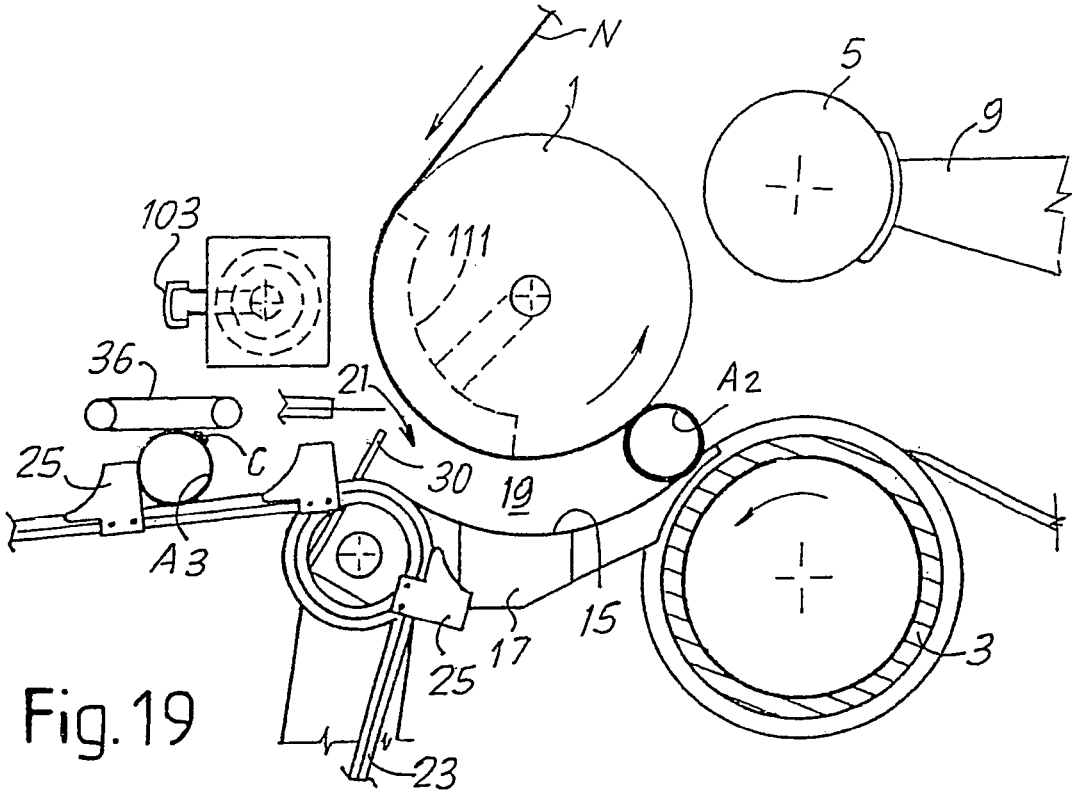
Figure 20:
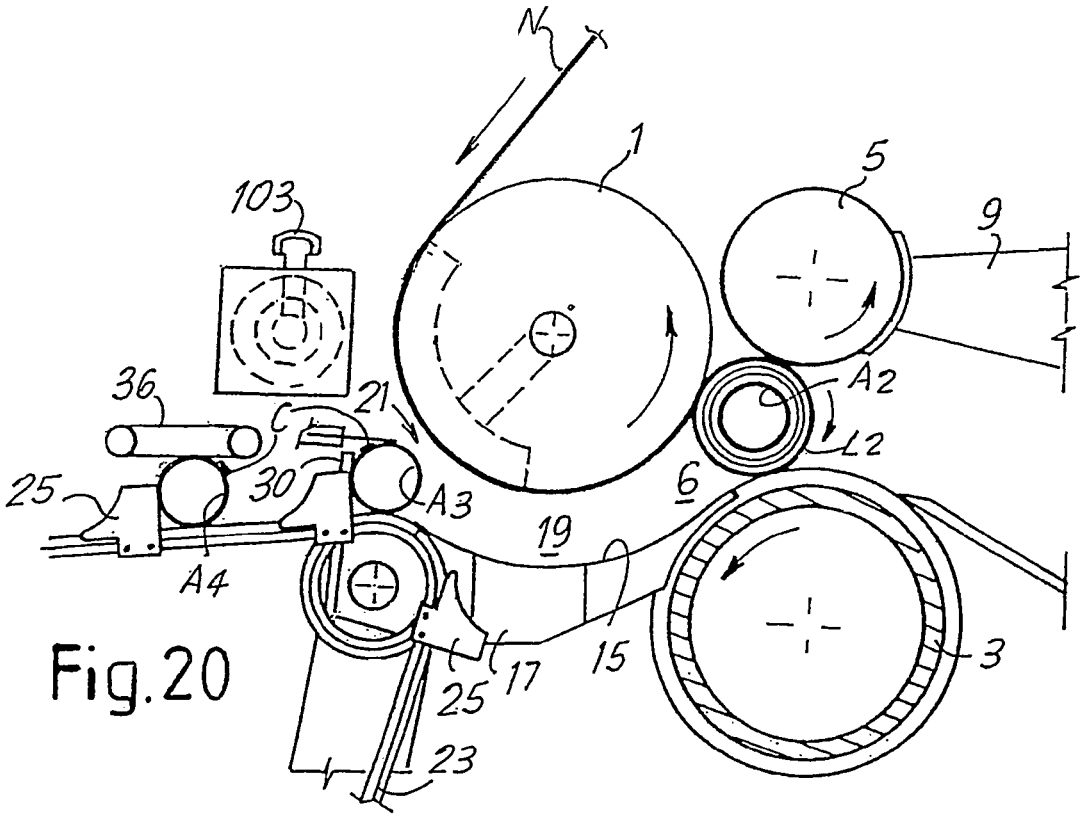

In FIG. 18 the core A2 has already traveled part of its path along the channel 19. In respect of the position in the previous FIG. 17, it is turned through more or less 360°, so that the band of glue C is back in the original position of FIG. 17 and, the moment subsequent to this, said band of glue comes into contact with the initial free edge L1 of the web material. This guarantees adhesion of said edge to the new core and allows winding of the subsequent log L2 to commence. FIGS. 19 and 20 show the moments subsequent to transfer of the core A2 to the winding cradle and forming of the log L2. In the meantime the previously formed log L1 has been unloaded from the winding cradle in a per se known way.

To guarantee control of the leading and tail edges L1 and Lf of the web material, which is severed upstream of the area of contact with the new core A2, this embodiment provides a holding system on the surface of the winding roller 1 which maintains control of the edges L1 and Lf from the area in which they are produced through the effect of the severing element 101 to the area of contact with the core. In this example, the edges Lf and L1 are held pneumatically; The winding roller 1 is equipped with a cylindrical sleeve at least partly perforated. A fixed suction chamber 111 is provided inside the roller 1, extending for an arc of more or less 180° from an area upstream of the point in which the web material N is pinched by the element 101 to an intermediate area along the channel 19. This guarantees hold, by suction through the holes in the cylindrical sleeve of the roller 1, of the edges L1 and Lf. Moreover, this prevents excessive slackening of the web material upstream of the element 101 during tearing. Above all, the edge L1 is held adhering to the roller 1 at least until the position in which it is pinched between the core A2 and the roller 1. The suction chamber 111 terminates its holding effect when the core and the initial edge L1 have reached the position of FIG. 18, so that when the holding action on the roller 1 terminates the edge L1 can adhere to the core A2. In this figure, C2 indicates a band of glue transferred from the core A2 to the final edge Lf of the completed log L1.

In practice, adhesion of the web material N to the core may also take place in a position spaced from the final edge of the initial free edge Li, as in any case this area remains wound inside the log to be formed subsequently. Instead, timing of the various elements of the machine must preferably allow the glue to close the log, applied to the final edge Lf to be as close as possible to the end of the final edge Lf, as this remains exposed on the outside of the log. The most advantageous condition is for the band of glue transferred from the core A to the web material N to be around 1 cm from the tearing edge, that is from the perforation line along which the web material is torn. This guarantees optimal closing and at the same time leaves a free edge for the final user to grip the web material and open the roll. Correct angular positioning of the core during feed into the channel 19 guarantees these optimal operating conditions.

It is understood that the drawing merely shows an example provided purely as a practical embodiment of the invention, which may vary in shapes and arrangements without however departing from the scope of the concept on which the invention is based. Any reference numbers in the appended claims are provided to facilitate reading of the claims with reference to the description and the drawing, and do not limit the scope of protection represented by the claims.

The invention claimed is:

1. A rewinding machine for producing logs of wound web material comprising:

a web advancement path, along which a web material is fed;

a core advancement path, along which winding cores are fed, said web material being wound around said cores to form said logs;

a winding cradle to wind the web material and form said logs, including a first winding roller around which said web material is fed and a second winding roller, said first winding roller and said second winding roller forming a nip therebetween; said web advancement path and said core advancement path extending through said nip; said web advancement path, said core advancement path and said first winding roller being arranged such that each core advanced along said core advancement path is caused to pinch the web material against said first winding roller, said logs being wound in contact with said first winding roller and said second winding roller;

means to sever the web material upon termination of winding each log, including a rotating severing element, cooperating with said first winding roller;

at least one first glue dispenser including a mechanical member that touches the web material at end of winding of said each log to apply a first glue to a portion of said web material, in proximity to a severing line, along which the web material is severed upon termination of winding said each log to form a final free edge and an initial free edge, said first glue gluing the final free edge of the log;

wherein said mechanical member of said first glue dispenser is integral with said severing element or is part of said severing element, and wherein said mechanical member, said web advancement path and said first winding roller are constructed and arranged such that the web material is fed between said mechanical member and said first winding roller when said mechanical member applies said glue to a portion of said web material contacting said first winding roller.

2. Rewinding machine as claimed in claim 1, wherein said severing element is controlled such that when said severing element is in contact with said web material said severing element has a peripheral speed differing in respect of said first winding element.

3. Rewinding machine as claimed in claim 1 or 2, wherein said severing element is integral to an assembly of rods at ends of which glue absorbent pads are integral.

4. Rewinding machine as claimed in claim 1, wherein said mechanical member is a rotating element.

5. Rewinding machine as claimed in claim 1, wherein said first glue dispenser applies said first glue to a portion of the web material wound around said first winding element.

6. Rewinding machine as claimed in claim 1, wherein said mechanical member has at least one pad suitable to pick up said first glue and to touch said web material, to transfer to said pad at least part of the glue picked up.

7. Rewinding machine as claimed in claim 1, further comprising a second gluing unit to apply a second glue to tubular winding cores.

8. Rewinding machine as claimed in claim 7, further comprising a rolling surface defining with said first winding element a channel to feed said winding cores; and wherein said winding cores are fed into said channel and made to roll inside the channel before the web material is severed.

9. Rewinding machine as claimed in claim 1, wherein said first glue dispenser applies said first glue along longitudinal bands, continuous or broken, on said web material.

10. Rewinding machine according to claim 1, further including a surface defining a channel along with said first winding element; and wherein said severing element and said mechanical member co-act with said first winding element along said channel.

11. Rewinding machine according to claim 10, further comprising a core feeder constructed and arranged to feed winding cores into said channel.

12. The rewinding machine according to claim 1, further including a surface defining with said first winding roller a channel to feed said winding cores, said core advancement path and said web advancement path extending along said channel, said first winding roller and said surface being constructed and arranged such that the cores advance along said channel by rolling on said surface and in contact with said web material fed around said first winding roller and wherein said first glue dispenser applies glue on said web along said channel.

13. The rewinding machine according to claim 1, wherein said first glue dispenser is constructed and arranged to apply glue on said web material downstream of a point of first contact of said core with said web material.

14. Method for producing logs of wound web material, comprising:

feeding a web material along a web advancement path;

sequentially feeding winding cores along a core advancement path;

winding a quantity of the web material around a first winding roller to form a first log in a winding nip formed by said first winding roller and a second winding roller, said web advancement path and said core advancement path each extending through said nip such that each core fed along the core advancement path pinches the web material against the first winding roller;

upon termination of winding said first log, severing the web material by a mechanical member where the web material is positioned between said mechanical member and said first winding roller to create a final edge of the first log and an initial edge to form a second log;

applying a first glue to a portion of the web material destined to remain wound on the first log, in proximity to the final free edge, which is glued to the first log upon termination of winding, wherein said first glue is applied to the web material by said mechanical member when the web material is present between the mechanical member and the first winding roller.

15. Method as claimed in claim 14, wherein said web material is wound around tubular winding cores.

16. Method as claimed in claim 15, further comprising applying a second glue to said tubular winding cores to fasten the initial free edge of the web material.

17. Method as claimed in claim 14, wherein said first glue is applied along a longitudinal line.

18. Method as claimed in claim 14, wherein said logs are wound with a peripheral winding system.

19. Method as claimed in claim 14, wherein said first glue is applied to the web material before severing of the web material.

20. Method as claimed in claim 14, wherein said first glue is a liquid or semi-liquid glue.

21. Method as claimed in claim 14, wherein said first glue is a strip of double-sided adhesive material.

22. The method according to claim 14, further including providing a surface in relation to said first winding roller to form a channel to feed said winding cores, said core advancement path and said web advancement path extending along said channel, said cores advancing along said channel by rolling on said surface and in contact with said web material fed around said first winding roller, and applying glue on said web along said channel by said mechanical member.

23. The method according to claim 14, wherein said first glue is applied on said web material downstream of a point of first contact of said core with said web material.

24. A rewinding machine for producing logs of wound web material comprising:

a web advancement path, along which the web material is fed;

a core advancement path, along which winding cores are fed, said web material being wound around said cores to form said logs;

a winding cradle to wind the web material and form said logs, including at least one winding element around which said web material is fed;

a surface defining with said first winding element a channel to feed said winding cores, said core advancement path and said web advancement path extending along said channel; said first winding element and said surface being arranged and constructed such that the cores advance along said channel by rolling on said surface and in contact with said web material fed around said first winding element;

means to sever the web material upon termination of winding each log, including a rotating severing element, cooperating with said first winding element;

at least one first glue dispenser including a mechanical member that touches the web material at end of winding of said each log to apply a first glue to a portion of said web material, in proximity to a severing line, along which the web material is severed upon termination of winding said each log to form a final free edge and an initial free edge, said first glue gluing the final free edge of the log;

wherein said mechanical member of said first glue dispenser is integral with said severing element or is part of said severing element, and wherein said mechanical member, said channel and said first winding element are constructed and arranged such that the web material is fed between said mechanical member and said first winding element when said mechanical member applies said glue to a portion of said web material contacting said first winding element and said mechanical member applies glue on said web along said channel.

25. The rewinding machine according to claim 24, wherein said first glue dispenser is constructed and arranged to apply glue on said web material downstream of a point of first contact of said core with said web material.

26. A rewinding machine for producing logs of wound web material comprising:

a web advancement path, along which the web material is fed;

a core advancement path along which winding cores are sequentially fed, said web material being wound around said winding cores;

a winding cradle to wind the web material and form said logs, including at least a first winding roller and a second winding roller, defining a nip therebetween, said core advancement path and said web advancement path extending through said nip and said web material being guided and fed around said first winding roller, said logs being formed by winding said web material around said cores keeping said logs being formed in contact with said first winding roller and said second winding roller;

means to sever the web material upon termination of winding each log, including a rotating severing element, cooperating with said first winding roller;

at least one first glue dispenser including a mechanical member that touches the web material at end of winding of said each log to apply a first glue to a portion of said web material, in proximity to a severing line, along which the web material is severed upon termination of winding said each log to form a final free edge and an initial free edge, said first glue gluing the final free edge of the log;

wherein said mechanical member of said first glue dispenser is integral with said severing element or is part of said severing element, and wherein said mechanical member, said web advancement path and said first winding roller are constructed and arranged such that the web material is fed between said mechanical member and said first winding roller when said mechanical member applies said glue to a portion of said web material contacting said first winding roller.

27. The rewinding machine according to claim 26, wherein said first glue dispenser is constructed and arranged to apply glue on said web material downstream of a point of first contact of said core with said web material.

28. The rewinding machine according to claim 26, further including a surface defining with said first winding roller a channel to feed said winding cores, said core advancement path and said web advancement path extending along said channel, said first winding roller and said surface being constructed and arranged such that the cores advance along said channel by rolling on said surface and in contact with said web material fed around said first winding roller and wherein said first glue dispenser applies glue on said web along said channel.

* * * * *